US007840163B2

(12) United States Patent
Takayama et al.

(10) Patent No.: US 7,840,163 B2
(45) Date of Patent: Nov. 23, 2010

(54) POSITION DETECTING DEVICE AND IMAGE FORMING APPARATUS

(75) Inventors: Hideyuki Takayama, Kanagawa (JP); Koichi Kudo, Kanagawa (JP); Takuro Kamiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 706 days.

(21) Appl. No.: 11/878,519

(22) Filed: Jul. 25, 2007

(65) Prior Publication Data

US 2008/0047157 A1 Feb. 28, 2008

(30) Foreign Application Priority Data

Jul. 27, 2006 (JP) ..... 2006-205327
Jun. 19, 2007 (JP) ..... 2007-161778

(51) Int. Cl.
*G03G 15/00* (2006.01)

(52) U.S. Cl. ..... 399/167; 399/162; 347/232

(58) Field of Classification Search ..... 399/167, 399/162, 116, 178, 159; 347/232
See application file for complete search history.

(56) References Cited

U.S. PATENT DOCUMENTS 6,336,019 B2 * 1/2002 Castelli et al. ..... 399/162
2004/0022557 A1 * 2/2004 Kudo ..... 399/167

FOREIGN PATENT DOCUMENTS

| | | |
|---|---|---|
| EP | 1 659 373 | 5/2006 |
| JP | 11-194564 | 7/1999 |
| JP | 3344614 B2 | 8/2002 |
| JP | 2006-139217 A | 6/2006 |
| JP | 2006-160512 A | 6/2006 |

OTHER PUBLICATIONS

Search Report dated Jan. 30, 2008 for corresponding European Application No. 07113164.3.

* cited by examiner

*Primary Examiner*—Lam S Nguyen
(74) *Attorney, Agent, or Firm*—Harness, Dickey & Pierce, P.L.C.

(57) ABSTRACT

A position detecting device includes a plurality of detecting units that detects marks on an object, a plurality of housing units that houses the detecting units, and a holding member that fixedly holds the housing units. A total expansion amount of the housing units due to temperature change is substantially equal to an expansion amount of the holding member between the fixed positions due to temperature change. The total expansion amount represents a total amount of expansion of the housing units from a fixed-position plane including a fixed position to a detection-position plane including a detection position in a direction parallel to a moving direction of the object. The fixed-position plane and the detection-position plane are perpendicular to the moving direction of the object.

12 Claims, 14 Drawing Sheets

POSITION DETECTING DEVICE AND IMAGE FORMING APPARATUS

CROSS-REFERENCE TO RELATED APPLICATIONS

The present application claims priority to and incorporates by reference the entire contents of Japanese priority documents, 2006-205327 filed in Japan on Jul. 27, 2006 and 2007-161778 filed in Japan on Jun. 19, 2007.

BACKGROUND OF THE INVENTION

1. Field of the Invention

The present invention relates to a position detecting device and an image forming apparatus.

2. Description of the Related Art

In image forming apparatuses, in particular, in a tandem color machine, image forming units that form images of yellow (Y), cyan (C), magenta (M), and black (K), respectively, are disposed side by side. The images of the respective colors are superimposed one on top of another on an intermediate transfer belt to form a full color image. Thus, color misregistration may occur and cause deterioration in image quality.

As an approach to this problem, technologies has been proposed in which a mark on an intermediate transfer belt is read to detect speed of the intermediate transfer belt. For example, Japanese Patent No. 3344614 discloses a technology for, in reading a reference mark formed on a transfer belt using two sensors, offsetting an error inherent in the reference mark and realizing accurate speed detection by acquiring an average speed of the belt in a time equivalent to several times of rotation of a driving roll. Japanese Patent Application Laid-Open No. 2006-160512 discloses a technology for providing a highly accurate belt transfer device by, in detecting a mark with two sensors, paying attention to fluctuation in an error of a mark interval, calculating a mark-pitch change from phase difference fluctuation of signals from the two sensors, and reflecting the mark-pitch change on a speed calculation to accurately detect a surface linear speed of a belt even if an error occurs in a mark pitch on the belt and perform feedback control. In such technologies, in general, the sensors (detecting units) are fixed to a holding member to locate detection positions of the sensors on perpendiculars to a belt conveying direction including positions for fixing the sensors to the holding member.

In an image forming apparatus, fixing operation or the like inevitably involves a temperature rise. With the former technology, speed of an intermediate transfer belt can be detected; however, the intermediate transfer belt is expanded and contracted due to a temperature change due to fixing operation, which results in misregistration. That is, the mark set as the reference is read using the two sensors. However, the sensors for detecting the mark are located on perpendicular lines to the conveying direction of the belt including the positions for fixing the sensors to the holding member. Thus, when temperature changes (rises), the holding member that fixes and holds the sensors is expanded and a space between the two sensors changes. As a result, the positions of the sensors for detecting the mark also change, and it is impossible to accurately detect the mark on the intermediate transfer belt and accurately detect speed of the intermediate transfer belt. In the latter technology, when the temperature changes, a sensor interval changes because of expansion of parts that fix the sensors. Thus, it is impossible to accurately detect the mark and a control error occurs.

SUMMARY OF THE INVENTION

It is an object of the present invention to at least partially solve the problems in the conventional technology.

According to an aspect of the present invention, a position detecting device includes a plurality of detecting units that faces a mark-formation area of an object where marks are formed at predetermined intervals, and detects the marks at detection positions while the object is moving, a plurality of housing units each housing one of the detecting units, and a holding member that fixedly holds the housing units at fixed positions. A total expansion amount of the housing units due to temperature change is substantially equal to an expansion amount of the holding member between the fixed positions due to temperature change. The total expansion amount represents a total amount of expansion of the housing units from a fixed-position plane to a detection-position plane in a direction parallel to a moving direction of the object. The fixed-position plane includes a fixed position and perpendicular to the moving direction of the object. The detection-position plane includes a detection position and perpendicular to the moving direction of the object.

According to another aspect of the present invention, an image forming apparatus includes a driving unit that drives an endless transfer member on which marks are formed at predetermined intervals, an image forming unit that forms an electrostatic latent image on a photosensitive member based on image data, forms a visual image from the electrostatic latent image, and transfers the visual image onto the endless transfer member, a position detecting unit that detects positions of the marks on the endless transfer member driven by the driving unit, a drive control unit that controls the driving unit based on the positions of the marks detected by the position detecting unit, and an output unit that transfers the visual image on the endless transfer member driven by the driving unit onto a recording medium. The position detecting unit includes a plurality of detecting units that faces a mark-formation area of the endless transfer member, and detects the marks at detection positions while the endless transfer member is moving, a plurality of housing units each housing one of the detecting units, and a holding member that fixedly holds the housing units at fixed positions. A total expansion amount of the housing units due to temperature change is substantially equal to an expansion amount of the holding member between the fixed positions due to temperature change. The total expansion amount represents a total amount of expansion of the housing units from a fixed-position plane to a detection-position plane in a direction parallel to a moving direction of the endless transfer member. The fixed-position plane includes a fixed position and perpendicular to the moving direction of the endless transfer member. The detection-position plane includes a detection position and perpendicular to the moving direction of the endless transfer member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

According to an embodiment of the present invention, a position detecting device includes two optical pickups that are provided correspondingly to a mark forming area of a transfer belt on which marks are formed at predetermined intervals and detect the marks on the moving transfer belt in predetermined detection positions, two cases that house the two optical pickups, respectively, and a circuit board (holding member) that fixes the two cases to fixed positions and holds the two cases. A total expansion amount as a total amount of expansion in a direction parallel to a moving direction of the transfer belt due to temperature changes in the two cases from a fixed-position plane including a fixed position and perpendicular to the moving direction of the transfer belt, to a detection-position plane including a detection positions and perpendicular to the moving direction of the transfer belt, is substantially equal to an expansion amount due to a temperature change in sections among a plurality of fixed positions on the circuit board.

Therefore, in the position detecting device, even if the transfer belt is expanded and contracted by a temperature change of the circuit board and a temperature change of the cases, expansion amounts due to the respective temperature changes are offset. Then, a distance between the detection positions of the two optical pickups is less easily affected by the temperature changes. This makes it possible to accurately detect positions of the marks on the transfer belt regardless of a temperature change.

When the position detecting device is applied to a drive control device that controls the driving of an endless belt, the drive control device can accurately calculate the expansion and contraction of an endless belt. Thus, the drive control device can precisely control the driving of the endless belt.

When the position detecting device is applied to an image forming apparatus, the image forming apparatus can accurately calculate the expansion and contraction of a transfer belt that transfers an image onto recording paper and, therefore, can accurately control driving of the transfer belt. Thus, the image forming apparatus can form a high-quality image with less color misregistration.

Figure 1:
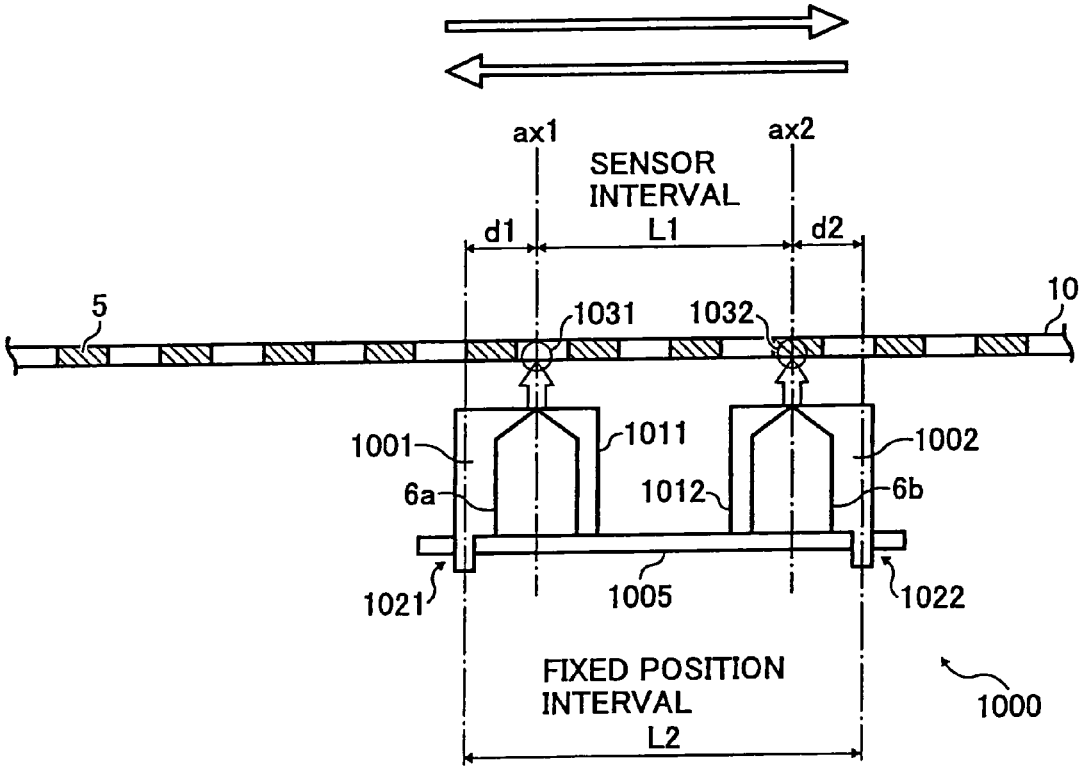
FIG. 1 is a schematic diagram for explaining a structure of a position detecting device according to a first embodiment of the present invention.
Figure 2:
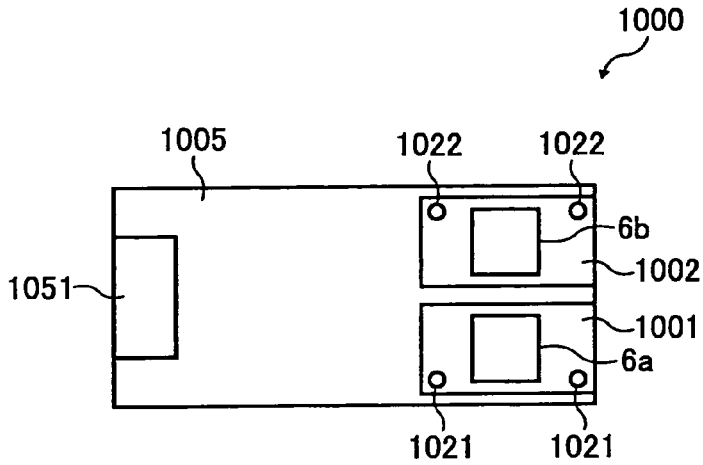
FIG. 2 is a overhead view of the position detecting device shown in FIG. 1.

FIG. 1 is a schematic diagram for explaining a structure of a position detecting device 1000 according to a first embodiment of the present invention. FIG. 2 is a plan view of the position detecting device 1000. By way of example and without limitation, the position detecting device 1000 is explained as being applied to an image forming apparatus.

The position detecting device 1000 includes a circuit board 1005, a mark detecting unit 1001, and a mark detecting unit 1002.

The mark detecting unit 1001 has a case 1011 and an optical pickup 6*a* housed in this case 1011. The mark detecting unit 1002 has a case 1012 and an optical pickup 6*b* housed in this case 1012. The optical pickups 6*a* and 6*b* are provided to be opposed to each other in a mark forming area of marks 5 formed at predetermined intervals on an intermediate transfer belt 10 conveyed in an arrow direction in FIG. 1. The optical pickups 6*a* and 6*b* detect the marks 5 on the transfer belt 10, which moves in the case of image formation, in predetermined detection positions. The intermediate transfer belt 10 is the one used in an image forming apparatus described later. In the first embodiment, the optical pickups as optical sensors are used as the sensors that detect positions of the marks. However, the present invention is not limited to this. For example, any sensor can be used as long as the sensor can detect positions of marks such as a magnetic sensor.

The circuit board 1005 in the position detecting device 1000 plays a function as a holding member that fixes the cases 1011 and 1012, which house the optical pickups 6*a* and 6*b*, to fixed positions and holds the same.

As shown in FIG. 2, the circuit board 1005 includes the mark detecting unit 1001, the mark detecting unit 1002, and a connector 1051. As shown in FIGS. 1 and 2, substantially circular holes are provided in fixed positions 1021 and 1022 near the side edges of the circuit board 1005. The fixed positions 1021 and 1022 are fixed positions where the cases 1011 and 1012 are fixed and held. As shown in FIG. 1, the cases 1011 and 1012 have substantially columnar projections near the side edges, respectively. These projections are fit into the fixed positions 1021 and 1022 provided near the side edges of the circuit board 1005, respectively. The cases 1011 and 1012 are fixed to the circuit board 1005 and held.

The projection of the case 1011 is provided at the side edge on the opposite side of the side edge opposed to the case 1012. The projection of the case 1012 is provided at the side edge on the opposite side of the side edge opposed to the case 1011. In the first embodiment, the substantially columnar projections provided in the cases are fit in the substantially circular holes to fix the cases to the circuit board. However, the present invention is not limited to this. The holes and the projections can be formed in any shapes as long as the cases can be fixed to the circuit board. For example, square pole projections are fit in square holes to fix the cases to the circuit board.

As shown in FIGS. 1 and 2, the cases 1011 and 1012 are fixed when the projections provided at the side edges thereof are fit into the fixed positions 1021 and 1022 of the circuit board 1005. Since areas from the projections fit into the fixed positions 1021 and 1022 to the side edges on the opposite side of the side edges where the projections are provided are not fixed, the cases 1011 and 1012 are freely stretchable. Therefore, a distance between the detection positions 1031 and 1032 of the optical pickups 6*a* and 6*b* changes because the optical pickups 6*a* and 6*b* housed in the cases 1011 and 1012 are relatively displaced with respect to the circuit board 1005 with the fixed positions 1021 and 1022 as references because of the expansion and contraction of the cases 1011 and 1012 due to a temperature change.

In general, image forming apparatuses, in particular, in a tandem color image forming apparatus, image forming units that form images of colors of yellow (Y), cyan (C), magenta (M), and black (K), respectively, are disposed side by side. The images of the respective colors are superimposed on an intermediate transfer belt to form a full color image. Thus, color misregistration may occur and cause deterioration in image quality. Therefore, in the conventional image forming apparatus, a detection speed is calculated by detecting positions of marks on the intermediate transfer belt to perform speed control for the intermediate transfer belt. However, when the position detecting device 1000 that measures expansion and contraction of the intermediate transfer belt is deformed by a temperature change, since detection positions of the marks shift, it is impossible to detect accurate positions of the marks.

Figure 19:
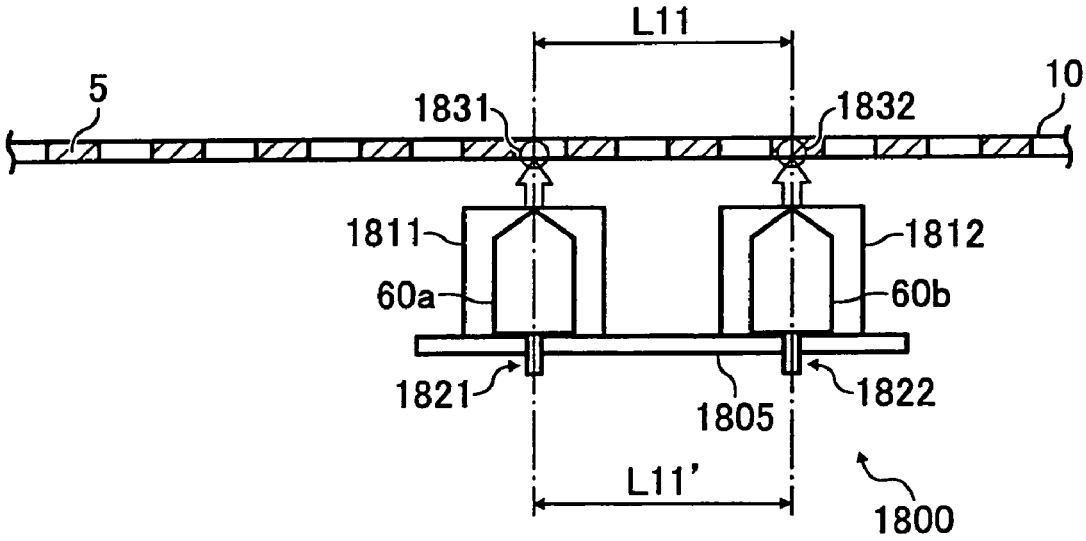
FIG. 19 is a schematic diagram for explaining a structure of a conventional position detecting device.

FIG. 19 is a schematic diagram for explaining a structure of a conventional position detecting device 1800. As shown in FIG. 19, in the conventional position detecting device 1800, detection positions 1831 and 1832 where two optical pickups 60*a* and 60*b* detect the marks 5 formed on the intermediate transfer belt 10 are located in the centers of cases 1811 and 1812 and are located on perpendiculars to the conveying direction of the intermediate transfer belt 10 including fixed positions 1821 and 1822 where the circuit board 1805 is fixed to the cases 1811 and 1812.

Therefore, even when the cases 1811 and 1812 are expanded and contracted by a temperature change of the position detecting device 1800, a distance between the detection positions 1831 and 1832 is not changed by the expansion and contraction. On the other hand, when the circuit board 1805 is expanded and contracted by the temperature change of the position detecting device 1800, a distance L11' between the fixed position 1821 and the fixed position 1822 changes. According to the change, the optical pickups 60*a* and 60*b* fixed to the circuit board 1805 also move. A distance L11 between the detection positions 1831 and 1832 of the optical pickups 60*a* and 60*b* also changes by an expansion amount same as the change of the fixed positions 1821 and 1822. Then, the distance between the detection positions 1831 and 1832 is changed by only the expansion of the circuit board 1805. Thus, the optical pickups 60*a* and 60*b* cannot accurately detect the positions of the marks 5 on the intermediate transfer belt 10. As a result, accurate speed detection cannot be performed.

On the other hand, with the structure shown in FIG. 1, the position detecting device 1000 appropriately selects physical quantities (parameters) such as a difference of an expansion amount due to a temperature change. Thus, a total expansion amount of the cases 1011 and 1012 and an expansion amount of the circuit board 1005 are offset. It is possible to keep the distance between the detection positions 1031 and 1032 of the optical pickups 6*a* and 6*b* housed in the cases 1011 and 1012 substantially constant.

The total expansion amount of a plurality of cases is, when a distance between fixed positions where the respective cases are fixed increases because of the movement of the respective cases following the expansion of a circuit board due to a temperature change, a total amount of expansion of the respective cases that are expanded in a direction in which the distance between the fixed positions is reduced, i.e., a direction in which an expansion amount of the circuit board is offset to return the distance between the fixed positions to the original distance. As described above, the circuit board 1005 and the cases 1011 and 1012 are expanded in the opposite directions and, when the cases 1011 and 1012 are expanded in the distances d1 and d2, the cases 1011 and 1012 are expanded in the distances d1 and d2 in a direction for offsetting an expansion amount of the circuit board 1005. Thus, an expansion amount of the distances d1 and d2 is added as a positive expansion amount.

As shown in FIG. 1, in the first embodiment, a distance between a plane (fixed-position plane) perpendicular to the conveying direction of the intermediate transfer belt 10 including the fixed position 1021 in the mark detecting unit 1001 and a plane (detection-position plane) perpendicular to the conveying direction of the intermediate transfer belt 10 including the detection position 1031 is a distance d1. A distance between a plane perpendicular to the conveying direction of the intermediate transfer belt 10 including the fixed position 1022 in the mark detecting unit 1002 and a plane perpendicular to the conveying direction of the intermediate transfer belt 10 including the detection position 1032 is a distance d2. A distance between the detection position 1031 and the detection position 1032 is a distance L1 and a distance between the fixed position 1021 and the fixed position 1022 is a distance L2. In this case, if a sum of an expansion amount in a direction parallel to the conveying direction of the intermediate transfer belt 10 due to a temperature change in the distance d1 of the case 1011 and an expansion amount in the direction parallel to the conveying direction of the intermediate transfer belt 10 due to a temperature change in the distance d2 of the case 1012 is substantially equal to an expansion amount due to a temperature change in the distance L2 between the fixed positions 1021 and 1022 of the circuit board 1005, the expansion amounts are offset. Thus, the distance L1 between the detection positions 1031 and 1032 is kept constant.

An expansion amount of a certain member is calculated as a product of a distance (length) of the member, a coefficient of linear expansion of the member, and a temperature-change amount of the member. Therefore, for example, the expansion amount in the distance d1 between the fixed position 1021 and the detection position 1031 in the case 1011 can be calculated as a product of the distance d1, a coefficient of linear expansion of the case 1011, and a temperature-change amount of the case 1011. The expansion amount in the distance L2 between the fixed position 1021 and the fixed position 1021 in the circuit board 1005 can be calculated as a product of the distance L2, a coefficient of linear expansion of the circuit board 1005, and a temperature-change amount of the circuit board 1005.

When the temperature of the position detecting device 1000 rises, since the circuit board 1005 is expanded at the coefficient of linear expansion of the circuit board 1005, the distance L2 between the fixed positions 1021 and 1022 changes to be large. In this case, since the projections near the side edges of the cases 1011 and 1012 are fixed to the fixed positions 1021 and 1022, the cases 1011 and 1012 move in a direction away from each other by an amount of change substantially equal to the amount of change in the distance L2 according to the expansion of the circuit board 1005. Moreover, according to the movement of the cases 1011 and 1012, the optical pickups 6*a* and 6*b* housed in the cases 1011 and 1012 also move in a direction away from each other by the amount of change substantially equal to the amount of change in the distance L2. As a result, the detection positions 1031 and 1032 of the optical pickups 6*a* and 6*b* also move in a direction away from each other by the amount of change substantially equal to the amount of change in the distance L2. The distance L1 increases by the amount of change substantially equal to the amount of change in the distance L2.

On the other hand, when the temperature of the position detecting device 1000 rises, the cases 1011 and 1012 are expanded at a coefficient of linear expansion of the cases. Since the projections near the side edges of the cases 1011 and 1012 are fixed to the fixed positions 1021 and 1022 as shown in FIG. 1, the cases 1011 and 1012 are expanded in a direction toward each other. Therefore, according to the expansion of the cases 1011 and 1012, the optical pickups 6*a* and 6*b* housed in the cases also move in a direction toward each other. The detection positions 1031 and 1032 also move in a direction toward each other. As a result, the distances d1 and d2 increase. Conversely, the distance L1 decreases by an amount of change substantially equal to a sum of amounts of change of the distances d1 and 2. As described above, a total expansion amount of a plurality of cases is a total amount of expansion of the respective cases that are expanded in a direction in which an expansion amount of a circuit board 1005 is offset and a distance between fixed positions is returned to an original distance. Therefore, in the first embodiment, a sum of the amount of change of the distance d1 and the amount of change of the distance d2, which is an expansion amount that offsets the expansion amount in the distance L2, is a total expansion amount.

If a sum of expansion amounts due to temperature changes in the distances d1 and d2 is equal to an expansion amount due to a temperature change in the distance L2 between the fixed positions of the circuit board 1005, the changed expansion amounts in the distances are offset. Thus, it is possible to control a change due to temperature of the distance L1 between the detection positions 1031 and 1032 of the optical pickups 6*a* and 6*b*.

The distance L2 between the fixed positions 1021 and 1022 near the side edges of the circuit board 1005 where the two mark detecting units 1001 and 1002 are fixed is set larger than the distance L1 between the detection positions 1031 and 1032 of the optical pickups 6*a* and 6*b*. The coefficient of linear expansion of the cases 1011 and 1012 is set larger than the coefficient of linear expansion of the circuit board 1005. Consequently, it is possible to easily increase a degree of offset of fluctuations in detected distances according to the difference between the expansion amounts due to the coefficients of linear expansion. However, it is also possible to offset fluctuation in a distance even if coefficients of linear expansion and a relation between distances are different from those described above.

Figure 3:
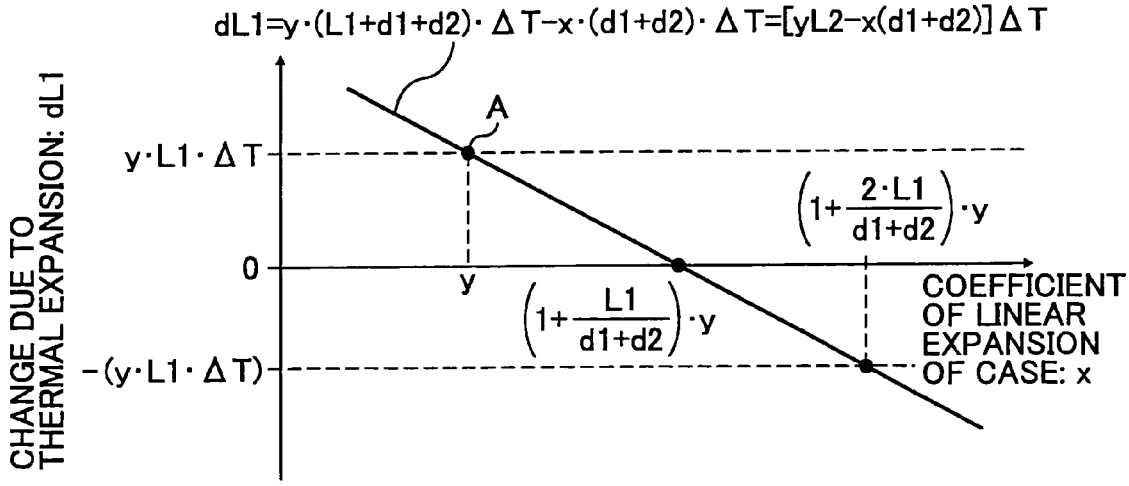
FIG. 3 is a graph for explaining an expansion change between detection positions of optical pickups in the position detecting device shown in FIG. 1.

FIG. 3 is a graph for explaining an expansion change between detection positions of the optical pickup in the position detecting device 1000. The coefficient of linear expansion of the cases 1011 and 1012 is "x" and the coefficient of linear expansion of the circuit board 1005 is "y". The circuit board 1005 also functions as a holding member that fixes and holds the cases 1011 and 1012. Since the cases 1011 and 1012 are formed of the same material, coefficients linear expansion of the cases 1011 and 1012 are also the same.

As described above, a distance between an optical axis ax1 of the optical pickup 6*a* of the mark detecting unit 1001 (perpendicular to the conveying direction of the intermediate transfer belt 10 including the detection position 1031) and the fixed position 1021 of the case 1011 of the optical pickup 6*a* is d1. A distance between an optical axis ax2 of the optical pickup 6*b* (perpendicular to the conveying direction of the intermediate transfer belt 10 including the detection position 1032) and the fixed position 1022 of the case 1012 of the optical pickup 6*b* is d2. A distance between the detection positions 1031 and 1032 of the optical pickups 6*a* and 6*b* is L1. A distance between the fixed positions 1021 and 1022 of the circuit board 1005 is L2.

For example, when a temperature change of the position detecting device 1000 is ΔT, a liner expansion amount due to a temperature change in the distance L2 between the fixed positions 1021 and 1022 is yL2ΔT. A sum of linear expansion amounts due to temperature changes in the distances d1 and d2 is x(d1+d2)ΔT. Therefore, a change in the distance L1 between the detection positions 1031 and 1032 of the optical pickups 6*a* and 6*b* is a value calculated by subtracting the sum of the linear expansion amounts due to a temperature changes in the distances d1 and d2 from the linear expansion amount due to a temperature change in the distance L2 between the fixed positions 1021 and 1022:

$$[yL2-x(d1+d2)]\Delta T$$

In FIG. 3, the abscissa indicates the coefficient of linear expansion "x" of the cases and the ordinate indicates dL1, which is an amount of change in the distance L1 between the detection positions 1031 and 1032. At a point A in FIG. 3, d1=d2=0, i.e., L1=L2. In other words, as in the general conventional example described above, the point A indicates thermal displacement that occurs when the cases are fixed to the circuit board on the optical axes of the optical pickups and changes in the detection positions of the optical pickup cannot be offset.

In the mark detecting unit 1001 and the mark detecting unit 1002, it is desirable to set the parameters to satisfy the following relation:

$$-(1/10)yL1 \leqq yL2-x(d1+d2) \leqq (1/10)yL1 \quad (1)$$

where "x", "y", d1, d2, and L2 are as described above.

When the temperature change of the position detecting device 1000 is ΔT, a linear expansion change due to a temperature change in the distance L2 between the fixed positions is [yL2−x(d1+d2)]ΔT as described above. Displacement between the optical pickups in a system in which the optical pickups are fixed to the holding member (circuit board) on the optical axes of the optical pickups, which is the general conventional example, is yL1ΔT as described above.

Therefore, when parameters are selected as indicated by Expression (1), compared with the conventional example, fluctuation in the distance between the detection positions 1031 and 1032 of the optical pickups 6*a* and 6*b* due to a temperature change is controlled to be equal to or smaller than 1/10 of that in the conventional example. In other words, by selecting and adopting the parameters as indicated by Expression (1), compared with the fluctuation in the optical pickups according to the conventional example, it is possible to control a change in the distance between the detection positions 1031 and 1032 of the optical pickups 6*a* and 6*b* due to a temperature change to be equal to or smaller than 1/10 of the fluctuation.

Moreover, it is desirable to set the parameters to satisfy the following relation:

$$-(1/100)yL1 \leqq yL2-x(d1+d2) \leqq (1/100)yL1 \quad (2)$$

When parameters are selected as indicated by Expression (2), compared with the conventional example, a change in a distance between the detection positions 1031 and 1032 of the optical pickups 6*a* and 6*b* due to a temperature change is controlled to be equal to or smaller than 1/100 of that in the conventional example.

Moreover, it is desirable to set the parameters such that a value of yL2−x(d1+d2) becomes substantially zero. When the parameters are selected in this way, compared with the fluctuation in the optical pickups according to the conventional example, it is possible to control a change in a distance between the detection positions 1031 and 1032 of the optical pickups 6*a* and 6*b* due to a temperature change to be nearly zero.

As described above, in the first embodiment, a change in the distance between the detection positions 1031 and 1032 of the optical pickups 6*a* and 6*b* is controlled to be 1/10, 1/100, or substantially zero compared with the conventional example. However, the present invention is not limited to this. The displacement of the distance between the detection positions 1031 and 1032 of the optical pickups 6*a* and 6*b* "[yL2−x(d1+d2)]ΔT" only has to be smaller than the displacement of the distance between the detection positions of the conventional optical pickups "yL1ΔT". Therefore, in general, "−CyL1≦yL2−x(d1+d2)≦CyL1" holds. In this case, "C" is a constant equal to or larger than 0 and smaller than 1. This is because, if "C" is set between 0 and 1, a displacement amount is surely smaller than the displacement of the distance between the detection positions of the conventional optical pickups "yL1ΔT".

The optical pickups 6*a* and 6*b* are fixed by fitting the projections of the cases 1011 and 1012 into the fixed positions 1021 and 1022 near the side edges of the circuit board 1005. However, the optical pickups 6*a* and 6*b* may be fixed by screws near the side edges. In short, it is sufficient that the side edges of the cases 1011 and 1012 are fixed at the side edges of the circuit board 1005 and the cases 1011 and 1012 can be stretchably displaced by a temperature change in other areas. This is because it is sufficient that shift of displacement due to a temperature change can be offset by a difference between coefficients of linear expansion of the circuit board 1005 and the cases 1011 and 1012.

In the first embodiment, the projections are provided at the side edges of the cases 1011 and 1012 and fixed to the circuit board 1005. However, the present invention is not limited to this. For example, the case 1011 can be fixed to the circuit board 1005 in any position between the perpendicular to the conveying direction of the intermediate transfer belt 10 including the detection position 1031 of the optical pickup 6*a* and the side edge on the opposite side of the side edge opposed to the case 1012. Similarly, the case 1012 can be fixed to the circuit board 1005 in any position between the perpendicular to the conveying direction of the intermediate transfer belt 10 including the detection position 1032 of the optical pickup 6*b* and the side edges on the opposite side of the side edge opposed to the case 1011. Unlike the conventional example, the cases 1011 and 1012 are not fixed on the perpendiculars to the conveying direction of the intermediate transfer belt 10 including the detection positions 1031 and 1032.

In the first embodiment, the circuit board is directly used as the holding member. On the other hand, in a modification of the first embodiment, the holding member is used separately from the circuit board. It is conceivable to use metal or resin as the holding member. When resin is used, resin with glass fiber is desirable. This is because a coefficient of linear expansion of the resin with glass fiber is smaller than that of resin alone. By setting a coefficient of linear expansion of the cases larger than that of the holding member, it is possible to increase an effect of controlling fluctuation in the distance between the detection positions of the optical pickups due to a temperature change.

Figure 4:
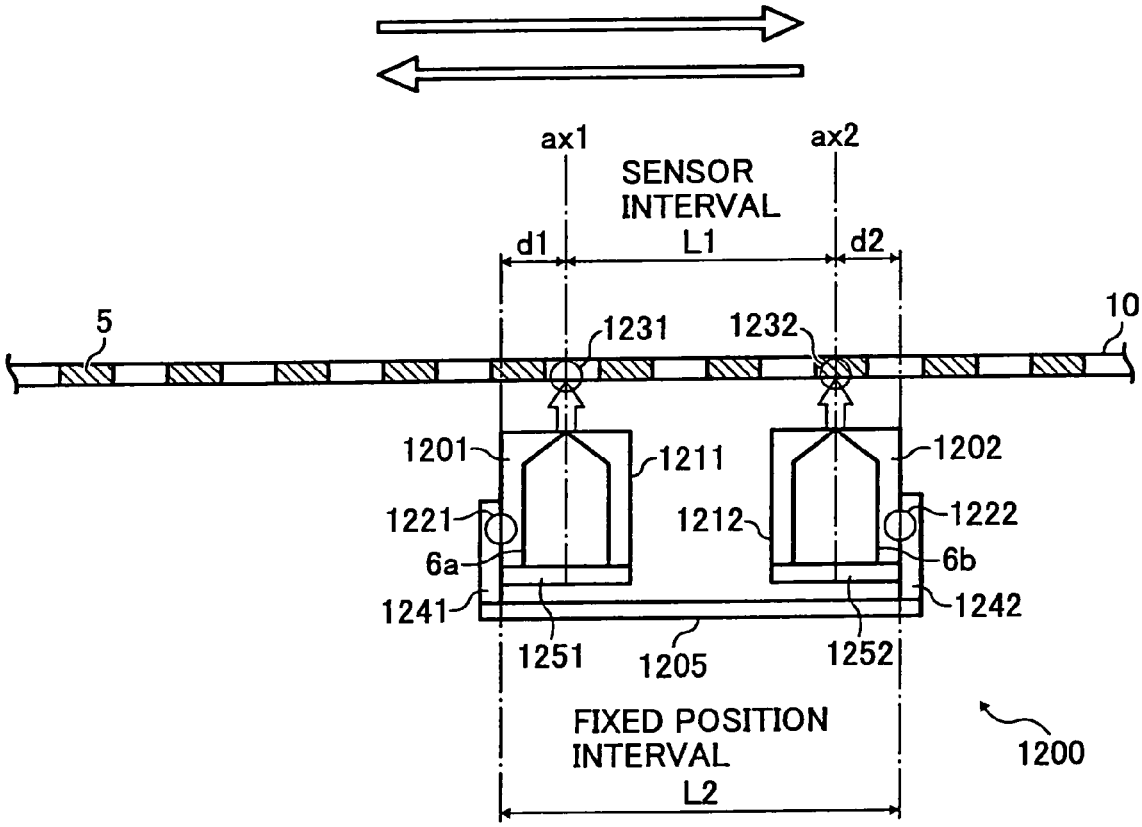
FIG. 4 is a schematic diagram for explaining a position detecting device according to a modification of the first embodiment.

FIG. 4 is a schematic diagram for explaining a position detecting device 1200 according to the modification of the first embodiment. As shown in FIG. 4, in the position detecting device 1200, supporting members 1241 and 1242 are fixed near the side edges of a holding member 1205 in a substantially perpendicular direction from the holding member 1205. Cases 1211 and 1212 of mark detecting units 1201 and 1202 house the optical pickups 6*a* and 6*b* disposed in bottom members 1251 and 1252. The supporting members 1241 and 1242 are fixed to the sides of the cases 1211 and 1212, respectively. Since the cases 1211 and 1212 are fixed with the supporting members 1241 and 1242 in fixed positions 1221 and 1222, the cases 1211 and 1212 are fixed and supported near the side edges of the holding member 1205 via the supporting members 1241 and 1242. The cases 1211 and 1212 are fixed to the supporting members 1241 and 1242. However, the cases 1211 and 1212 are freely displaced with respect the holding member 1205 by expansion and contraction due to a temperature change.

As described above, in the modification of the first embodiment, the optical pickups 6*a* and 6*b* are fixed near the side edges of the holding member 1205 via the supporting members 1241 and 1242. Otherwise, the position detecting device 1200 is of basically the same structure and operates in the same manner as the position detecting device 1000, and the same description is not repeated. In the modification of the first embodiment, as in the first embodiment, when the temperature of the position detecting device 1200 changes, expansion amounts due to a temperature change of the holding member 1205 and the cases 1211 and 1212 are offset. Thus, it is possible to control fluctuation due to a temperature change in the distance L1 between the detection positions 1231 and 1232 of the optical pickups 6*a* and 6*b*.

In the modification of the first embodiment, the circuit board is not used as the holding member and the supporting members 1241 and 1242 are provided in the holding member 1205 separate from the circuit board. Consequently, it is possible to more surely secure a higher degree of freedom of parameters. It is also possible to increase a degree of freedom of design and reduce a change in a distance between the detection positions 1231 and 1232 of the optical pickups 6*a* and 6*b* due to a temperature change.

It is desirable to use a metal material as the holding member. The metal material has high rigidity and a small coefficient of thermal expansion due to a temperature change. Therefore, a degree of freedom for reducing the displacement of a distance due to a temperature change increases. When the position detecting device is applied to an image forming apparatus, it is possible to provide a high-quality image.

Figure 5:
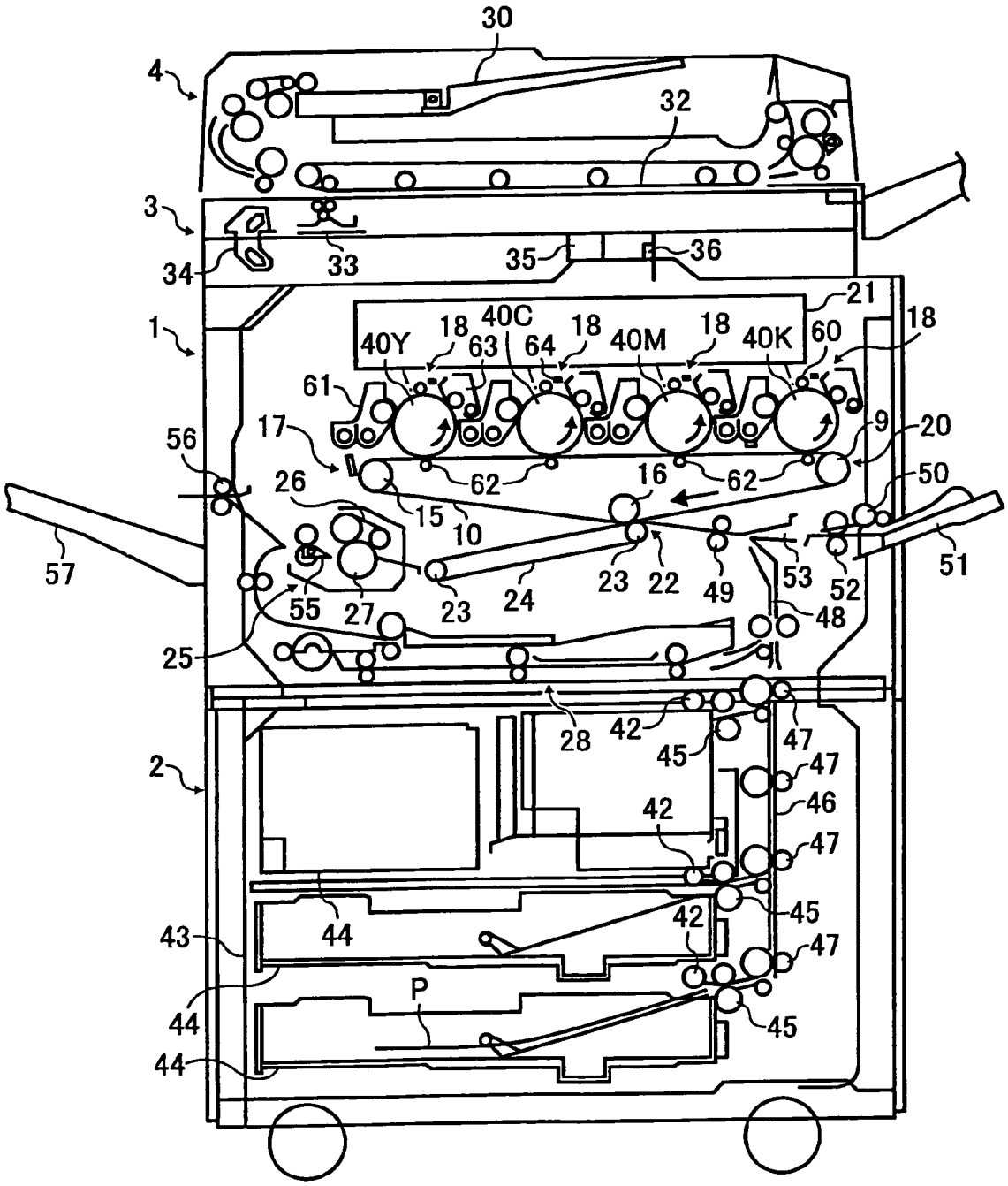
FIG. 5 is a schematic diagram of an image forming apparatus including the position detecting device and a drive control device.
Figure 6:
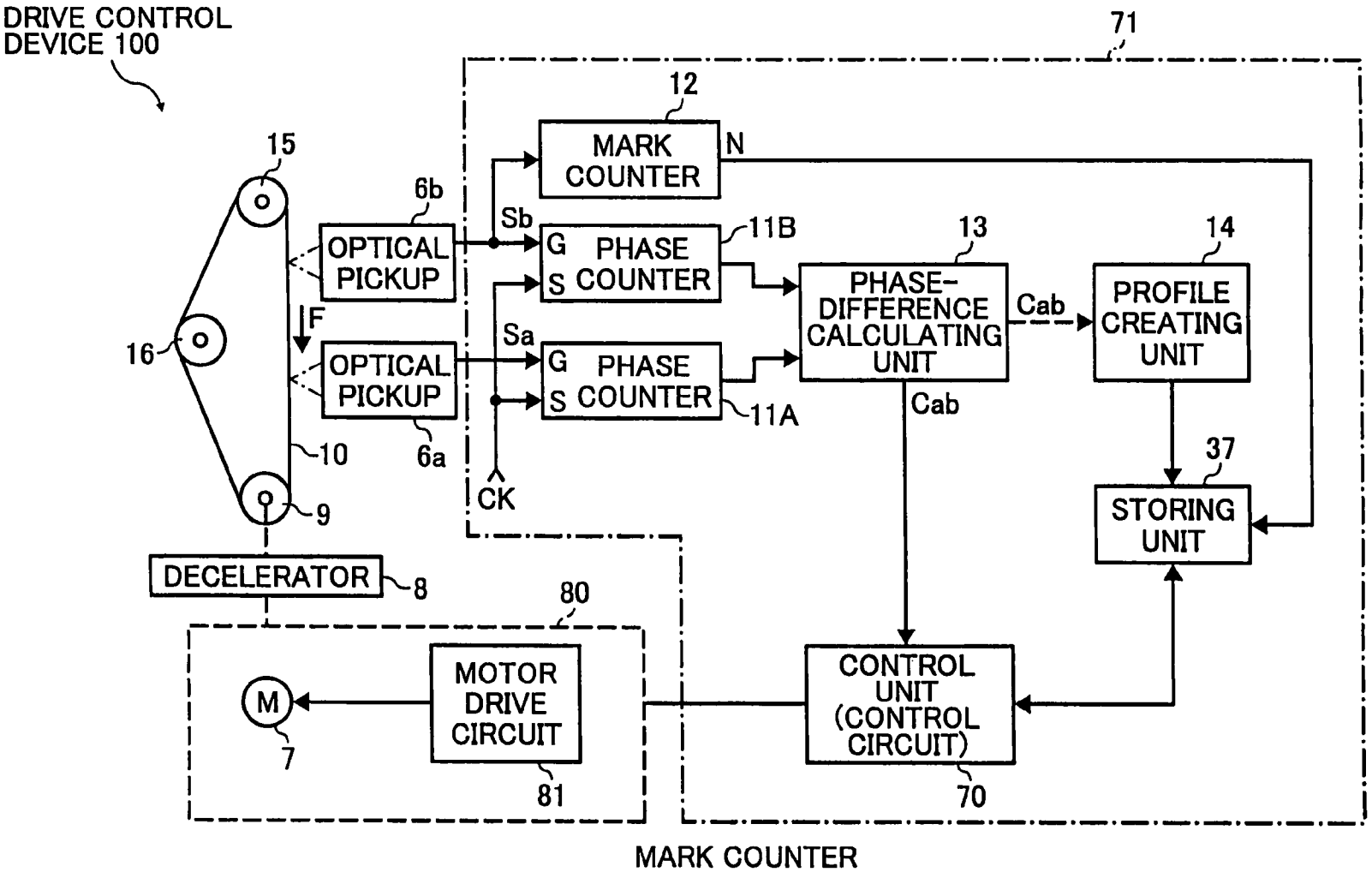
FIG. 6 is a functional block diagram of the drive control device including the position detecting device.

FIG. 5 is a schematic diagram of an image forming apparatus including the position detecting device 1000 and a drive control device. FIG. 6 is a functional block diagram of a drive control device 100 including the position detecting device 1000. The image forming apparatus shown in FIG. 5 is a tandem color image forming apparatus including four image forming units.

The image forming apparatus includes a main body 1, a sheet feeding table 2 below the main body 1, and a scanner 3 on the main body 1. An auto document feeder (ADF) 4 is attached on the scanner 3. A transfer device 20 having the intermediate transfer belt 10 as a belt-like endless moving member is provided substantially in the center in the main body 1. The intermediate transfer belt 10 extends around a driving roller 9 and two driven rollers 15 and 16 and rotates counterclockwise in FIG. 5.

A residual toner remaining on the surface of the intermediate transfer belt 10 after image transfer is removed by a cleaning device 17 provided on the left of the driven roller 15. Above a linear section of the intermediate transfer belt 10 extending around the driving roller 9 and the driven roller 15, four drum-like photosensitive members 40Y, 40C, 40M, and 40K (hereinafter simply referred to as photosensitive members 40 when the photosensitive members are not identified) are disposed at predetermined intervals along a moving direction of the intermediate transfer belt 10. Four primary transfer rollers 62 are provided to be opposed to the respective photosensitive members 40 on the inner side of the intermediate transfer belt 10 to hold the intermediate transfer belt 10 between the primary transfer rollers 62 and the photosensitive members 40.

The four photosensitive members 40 are rotatable counterclockwise in FIG. 5. Around each of the photosensitive members 40 are arranged charging devices 60, developing devices 61, the primary transfer rollers 62, photosensitive member cleaning devices 63, and charge removing devices 64. The charging devices 60, the developing devices 61, the primary transfer rollers 62, the photosensitive member cleaning devices 63, and the charge removing devices 64 each constitute an image forming unit 18. Above the four image forming units 18 is arranged a common exposing device 21. Images (toner images) formed on the photosensitive members are sequentially transferred onto the intermediate transfer belt 10 to be directly superimposed one another.

On the other hand, below the intermediate transfer belt 10, a secondary transfer device 22 serving as a transfer unit that transfers an image on the intermediate transfer belt 10 onto a sheet P serving as recording paper is provided. In the secondary transfer device 22, a secondary transfer belt 24 as an endless belt is laid over between two rollers 23. The secondary transfer belt 24 is pressed against the driven roller 16 via the intermediate transfer belt 10.

The secondary transfer device 22 collectively transfers toner images on the intermediate transfer belt 10 onto the sheet P fed to a space between the secondary transfer belt 24 and the intermediate transfer belt 10. On a downstream side in a sheet conveying direction of the secondary transfer device 22, a fixing device 25 that fixes the toner images on the sheet P is provided. A pressure roller 27 is pressed against the fixing belt 26 as the endless belt in the fixing device 25.

The secondary transfer device 22 also plays a function of conveying a sheet after the image transfer to the fixing device 25. The secondary transfer device 22 may be a transfer device that uses a transfer roller and a non-contact charger. Below the secondary transfer device 22, a sheet reversing device 28 that reverses a sheet when images are formed on both sides of the sheets is provided. In this way, this main body 1 constitutes a tandem color image forming apparatus of an indirect transfer system.

When a user takes a color copy using this color image forming apparatus, the user sets an original on an original stand 30 of an auto document feeder 4. When the user sets the original manually, the user opens the auto document feeder 4, sets the original on a contact glass 32 of the scanner 3, and closes the auto document feeder 4 to press the original.

When the user presses a not-shown start key, the original set on the auto document feeder 4 is fed onto the contact glass 32. When the original is set on the contact glass 32 manually, the scanner 3 is immediately driven and a first traveling member 33 and a second traveling member 34 start traveling. Light from a light source of the first traveling member 33 is irradiated on the original. Reflected light from the surface of the original travels to the second traveling member 34. The light is reflected on a mirror of the second traveling member 34 and made incident on a reading sensor 36 through an imaging lens 35 and content of the original is read.

The intermediate transfer belt 10 starts rotation according to the depression of the start key. At the same time, the respective photosensitive members 40Y, 40C, 40M, and 40K starts rotation and starts an operation for forming single color toner images of yellow (Y), cyan (C), magenta (M), and black (K) on the respective photosensitive members. The toner images of the respective colors formed on the respective photosensitive members are sequentially transferred onto the intermediate transfer belt 10, which rotates clockwise in FIG. 5, to be superimposed one another. As a result, a full color image is formed.

On the other hand, a sheet feeding roller 42 of a selected sheet feeding shelf in the sheet feeding table 2 rotates according to the depression of the start key. The sheets P are delivered from one selected sheet feeding cassette 44 in a paper bank 43 and separated one by one by separating rollers 45. The sheet P separated is conveyed to a sheet feeding path 46. The sheet P is conveyed to a sheet feeding path 48 in the main body 1 by conveying rollers 47 and collides with registration rollers 49 and temporarily stops.

In the case of the manual sheet feeding, the sheets P set on a bypass tray 51 are delivered by the rotation of a sheet feeding roller 50 and separated one by one by separating rollers 52. The sheet P separated is conveyed to a bypass path 53 and collides with the registration rollers 49 and comes into a temporarily stop state. The registration rollers 49 start rotations at accurate timing adjusted to the combined color image on the intermediate transfer belt 10 and feed the sheet P in the temporary stop state into a space between the intermediate transfer belt 10 and the secondary transfer device 22. The color image is transferred onto the sheet P in the secondary transfer device 22.

The sheet P having the color image transferred thereon is conveyed to the fixing device 25 by the secondary transfer device 22 that also has a function of a conveying device. Heat and a pressing force are applied to the sheet P in the fixing device 25, whereby the color image is fixed on the sheet P. Thereafter, the sheet P is guided to a discharge side by a switching pawl 55, discharged onto a sheet discharge tray 57 by a discharging roller 56, and stacked thereon. When a duplex copy mode is selected, the sheet P having an image formed on one side thereof is conveyed to the sheet reversing device 28 side by the switching pawl 55, reversed in the sheet reversing device 28, and guided to the transfer position again.

After the image is formed on the rear side, the sheet P is discharged onto the sheet discharge tray 57 by the discharging roller 56.

Figure 7:
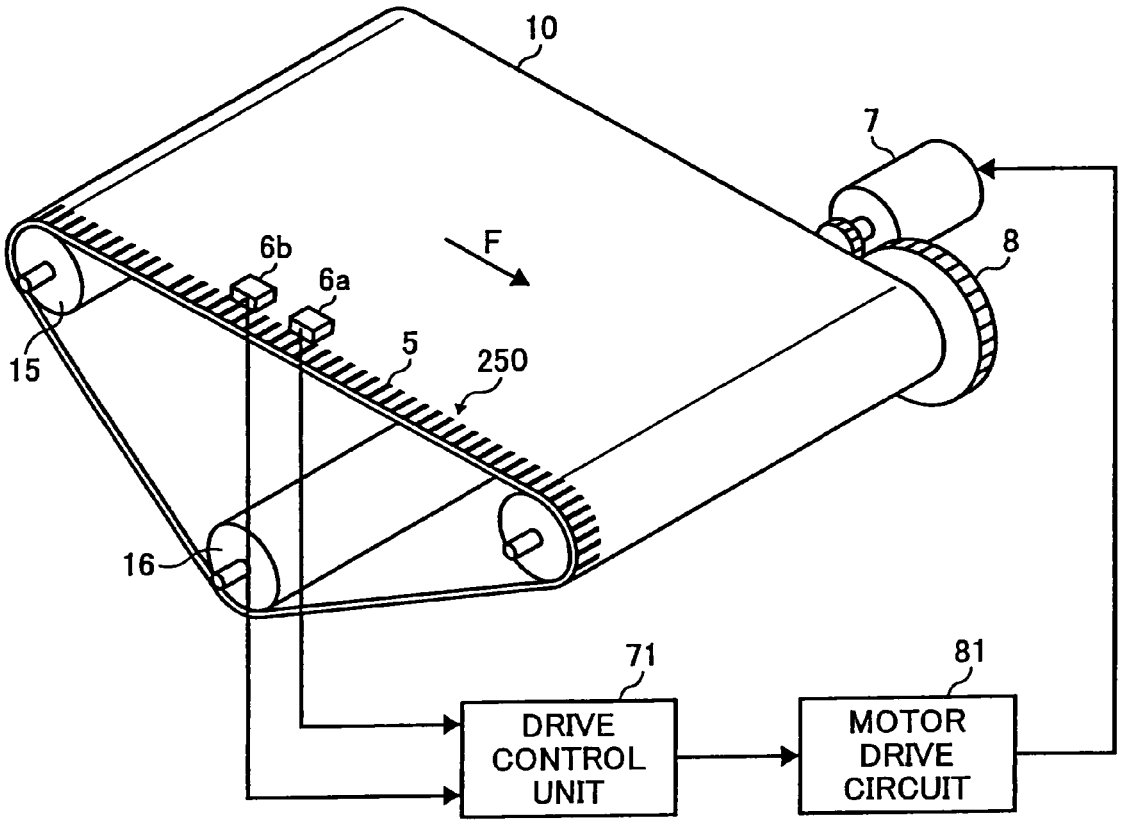
FIG. 7 is a schematic diagram for explaining drive control for a transfer belt by the drive control device.

FIG. 7 is a schematic diagram for explaining drive control for the transfer belt by the drive control device 100.

The drive control device 100 includes the position detecting device 1000. Specifically, the drive control device 100 includes a drive control unit 71 that receives signals from the optical pickups 6*a* and 6*b*, which reads marks on the transfer belt 10, and controls a motor drive circuit 81 and a driving unit 80 that drives the transfer belt 10.

The intermediate transfer belt 10 as an endless moving member extends around the driving roller 9 and the driven roller 15. A tension is applied to the intermediate transfer belt 10 by the driven roller 16. When the driving roller 9 is rotated by a motor 7 via a decelerator 8, the intermediate transfer belt 10 rotates in an arrow F direction. The intermediate transfer belt 10 is a belt formed of, for example, fluorine resin, polycarbonate resin, or polyimide resin. An elastic belt, all layers or a part of the layers of which are formed of an elastic member, is often used as the intermediate transfer belt 10.

On the intermediate transfer belt 10, a plurality of marks 5 (FIG. 7) is formed at predetermined intervals (pitches) over a moving direction along one side edge of an outer circumferential surface thereof. In this example, a large number of marks 5 are provided over the entire circumference of the intermediate transfer belt 10 to form a scale 250 at extremely small pitches (equal intervals). In FIG. 7, the marks 5 are shown in black in a scale form. Actually, the marks 5 are printed with an ink or the like having a reflectance higher than that of the surface of the intermediate transfer belt 10, or a tape on which the marks having a reflectance different from a reflectance of a base is stuck to the entire circumference of the intermediate transfer belt 10.

Above the side edges of the intermediate transfer belt where the marks 5 are provided, the two optical pickups 6*a* and 6*b* are arranged in positions different from one another at small intervals in a moving direction of the intermediate transfer belt 10.

Figure 8:
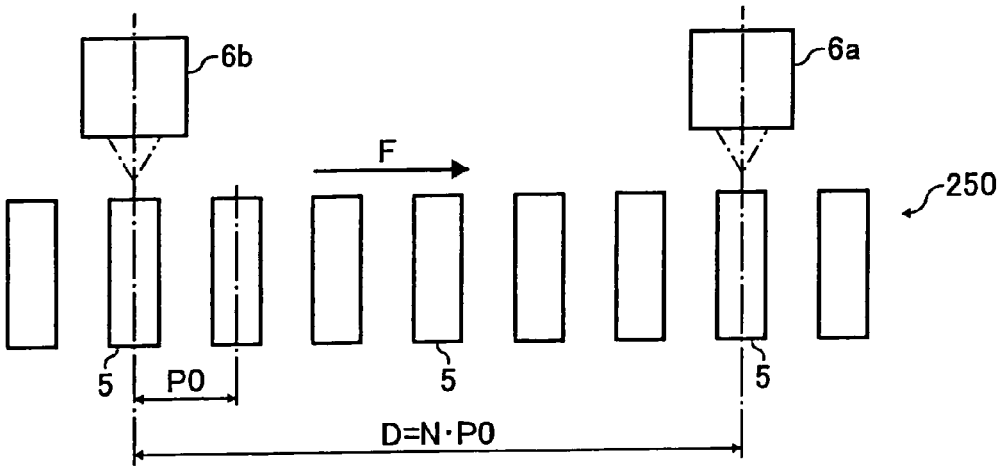
FIG. 8 is a schematic diagram for explaining an positional relation between marks formed on an intermediate transfer belt and optical pickups.

FIG. 8 is a schematic diagram for explaining an positional relation between the marks formed on the intermediate transfer belt and the optical pickups 6*a* and 6*b*. When a design values of the intervals (pitches) of the marks 5 forming the scale 250 is P0, it is desirable to set an interval D between detection points of the optical pickups 6*a* and 6*b* to be integer times as large as the pitch P0 of the marks 5, i.e., D=N*P0 (N: 1, 2, 3, . . . ). In the first embodiment, the optical pickup 6*a* is located on the downstream side in the moving direction (direction indicated by the arrow F) of the intermediate transfer belt 10 and the optical pickup 6*b* is located on the upstream side. The optical pickups 6*a* and 6*b* are of like structure, and thus they are sometimes collectively referred to as the optical pickup 6.

When the motor 7 is driven by the motor drive circuit 81 and rotates the driving roller 9 via the decelerator 8, the intermediate transfer belt 10 is rotated in the arrow F direction. According to the movement of the intermediate transfer belt 10, the two optical pickups 6*a* and 6*b* inputs signals for detecting the marks 5 of the scale 250 to the drive control unit 71. The drive control unit 71 feedback-controls the motor drive circuit 81 based on a phase difference of the input signal and highly accurately controls a moving speed of the intermediate transfer belt 10. Details of the drive control unit 71 are explained later.

Figure 9:
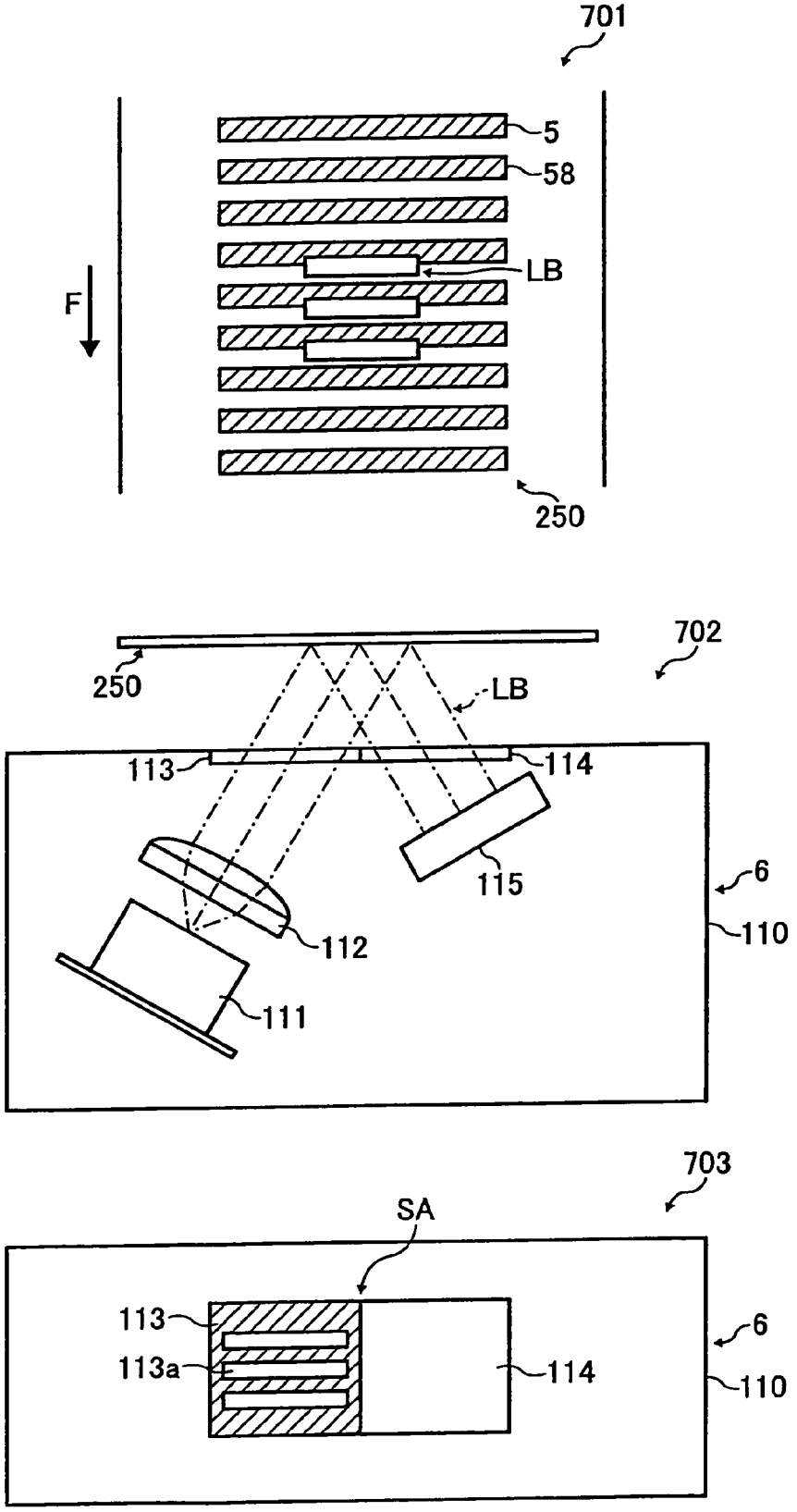
FIG. 9 is an example of a scale formed of a plurality of marks on the outer circumferential surface of the intermediate transfer belt and an optical pickup.

FIG. 9 is an example of the scale 250 including the marks 5 provided on the outer circumferential surface of the intermediate transfer belt 10 and the optical pickup 6. Reference numeral 701 represents an overhead view of a part of the scale 250. Reference numeral 702 represents a side perspective view of an optical system of the optical pickup 6 and optical paths, shown upside down for convenience of illustration. Reference numeral 703 represents a plan view of a detection surface of the optical pickup 6.

The scale 250 is a reflection-type scale. In the scale 250, the marks (reflecting sections) 5 and light shielding sections 58 are alternately formed on the outer circumferential surface (or may be the inner circumferential surface) of the intermediate transfer belt 10 along a rotating direction of the intermediate transfer belt 10. In the optical pickup 6, a light emitting element 111 such as an LED, a collimate lens 112, a light receiving window 114 provided with a slit mask 113 clearly indicated in 703 of FIG. 9 and a transparent cover of glass, a transparent resin film, or the like, a light receiving element 115 such as a phototransistor, and the like are fixed to a housing 110.

In the optical pickup 6, light emitted by the light emitting element 111 serving as a light source passes through the collimate lens 112 and changes to parallel rays. The parallel rays are divided into a plurality of light beams LB through the slit mask 113 in which a plurality of slits 113*a* is arranged in parallel to the scale 250. The light beams LB are irradiated on the scale 250 on the intermediate transfer belt. A part of the light beams LB are reflected by the marks 5. The reflected light is received by the light receiving element 115 through the light receiving window 114. The light receiving element 115 converts light and shade of the reflected light into electric signals.

Thus, the light receiving element 115 in the housing 110 of the optical pickup 5 detects the marks 5 of the scale 250 by receiving the reflected light. The light receiving element 115 outputs analog alternating signals continuously modified according to presence or absence of reflection by the rotation of the intermediate transfer belt.

Figure 10:
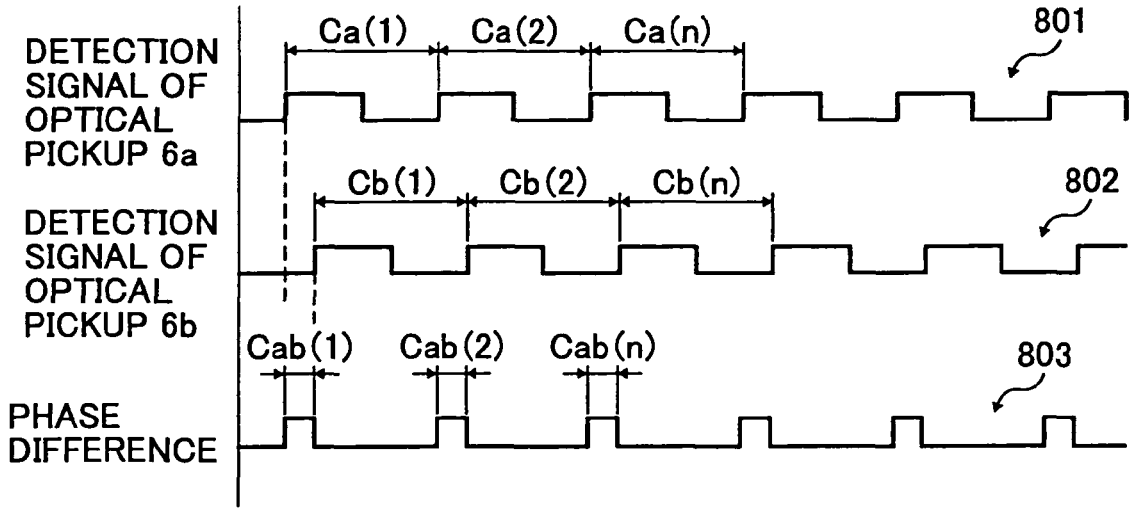
FIG. 10 is a timing chart of a relation between waveforms obtained by shaping output signals of two optical pickups and a phase difference between the waveforms.

FIG. 10 is a timing chart of a relation between waveforms obtained by shaping output signals of the two optical pickups 6*a* and 6*b* and a phase difference between the waveforms. In FIG. 10, pulse signals obtained by waveform-shaping the analog alternating signals outputted by the light receiving element 115 are shown. The pulse signals waveform-shaped as shown in FIG. 10 are pulse signals of rectangular waves.

In FIG. 10, a signal 801 indicates a waveform of a detection signal of the optical pickup 6*a*. Ca(1), Ca(2), and Ca(n) indicate cycles of the signal 801. A signal 802 indicates a waveform of a detection signal of the optical pickup 6*b*. Cb(1), Cb(2), and Cb(1) indicate cycles of the signal 802. A signal 803 indicates a waveform of a phase difference between the detection signals of the optical pickups 6*a* and 6*b*. Cab(1), Cab(2), and Cab(n) are phase differences of the signal 803.

Figure 11:
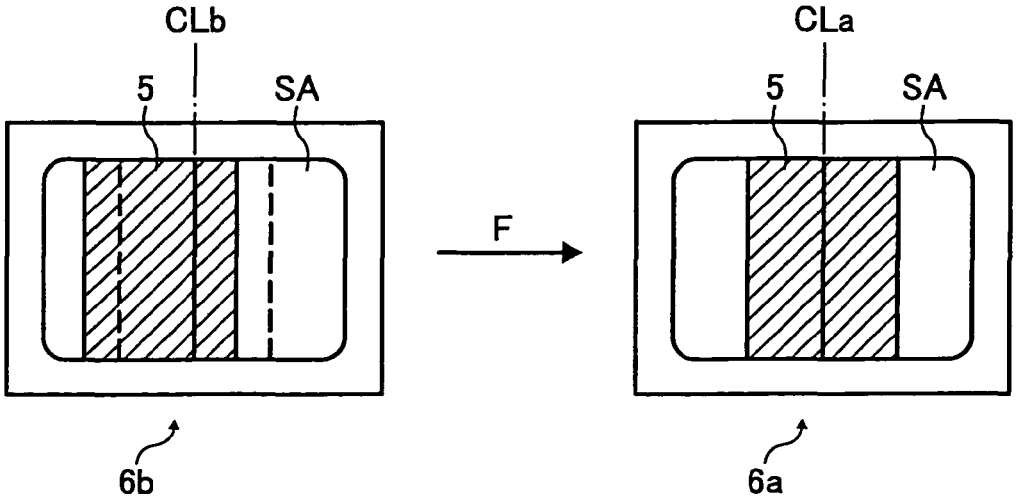
FIG. 11 is a schematic diagram for explaining a positional relation between a mark detection area of the optical pickups and marks to be detected.

FIG. 11 is a schematic diagram for explaining a positional relation between a mark detection area SA of the two optical pickups 6*a* and 6*b* and the marks 5 to be detected. An area including the slit mask 113 and the light receiving window 114 in the detection surface of the optical pickup 6 indicated by reference numeral 703 in FIG. 9 is the mark detection area SA.

As shown in FIG. 8, the pitch P0 of the marks 5 is still a design value (initial value) and the interval D between the two optical pickups 6*a* and 6*b* is accurately N*P0. In this case, when a center line CLa of the mark detection area SA of the optical pickup 6*a* shown on the right side in FIG. 11 coincides with the center of the width of the mark 5 being detected, the mark 5 corresponding to the mark detection area SA of the optical pickup 6*b* shown on the left side is also in a position indicated by broken lines and the center of the width of the mark 5 coincides with a center line CLb of the mark detection area SA. Therefore, timing of a rising edge and timing of a falling edge of waveforms obtained by shaping output signals of the optical pickups 6*a* and 6*b* coincide with each other and a phase difference Cab between the waveforms is 0.

However, actually, the intermediate transfer belt 10 are expanded and contracted by the temperature and the humidity in the apparatus, a tension applied to the intermediate transfer belt 10, and the like. The positions of the marks 5 of the scale 250 also shift. Therefore, when the center line CLa of the mark detection area SA of the optical pickup 6*a* shown on the right side in FIG. 11 coincides with the center of the width of the mark 5 being detected, the position of the mark 5 corresponding to the mark detection area SA of the optical pickup 6*b* shown on the left side shifts as indicated by solid lines. The center of the width of the mark 5 shifts from the center line CLb of the mark detection area SA (when the pitch of the mark 5 extends, the center shifts to a position delayed in the moving direction of the intermediate transfer belt 10 indicated by an arrow F). Consequently, the timing of the rising edge and the falling edge of the waveforms obtained by shaping the output signals of the optical pickups 6*a* and 6*b* shift as shown in FIG. 10 and the phase difference Cab shown in FIG. 10 is caused.

An extension amount ΔL of the pitch of the mark 5 is expressed as δt=ΔL/V where δt is a delay time due to the extension of the pitch, and V is a linear velocity of the intermediate transfer belt 10. If cycles of the detection signals of the optical pickups 6*a* and 6*b* is represented as Ca=Cb=T, the phase difference Cab is calculated as follows:

$$Cab=\delta t/T=\Delta L/V*T \tag{3}$$

Therefore, the phase difference Cab changes in proportion to the extension amount (amount of change) ΔL of the pitch.

A rate of change R of the extension is calculated as follows:

$$R=\Delta L/L=\delta t*V/L \tag{4}$$

where L is an interval between the optical pickups 6*a* and 6*b*.

An actual belt linear velocity Vreal is calculated taking into account the extension of the scale by P/T using the pitch (scale pitch) P of the marks 5 as follows:

$$V\text{real}=P(1+R)/T \tag{5}$$

A cumulative moving distance Lreal is calculated by multiplying a count value "N" of the detection signal of the optical pickup 6*a* or 6*b* by the scale pitch "P" as follows:

$$\begin{aligned} Lreal &= N*P+\Sigma[\Delta L(k)] \\ &= N*P+\Sigma[P*R(k)] \\ &= N*P\{1+\Sigma(P(k))\} \end{aligned} \tag{6}$$

A moving distance added with an integral value of extension amounts is calculated as an actual cumulative moving distance.

In control performed without taking into account a scale pitch error, a difference between the pulse interval Ca(n) or Cb(n) of the detection signal of one optical pickup 6 and a standard pulse interval C0 is feedback controlled.

A difference ΔV between a reference velocity Vref and a real velocity Vreal to be fed back is calculated as follows:

$$\begin{aligned} \Delta V &= Vref-Vreal \\ &= fc*P0/C0-fc*Pa(n)/Ca(n) \end{aligned} \tag{7}$$

fc: Counter clock

P0: Standard scale pitch

C0: Standard clock count number per one cycle of the detection signal of the optical pickup Pa(n): Scale pitch added with an error Ca(n): Actual clock count number per one cycle of the detection signal of the optical pickup Referring back to FIG. 6, components corresponding to those in FIG. 7 and the like explained above are denoted by the identical reference numerals and signs and explanations of the components are omitted.

In FIG. 6, phase counters 11A and 11B, a mark counter 12, a phase-difference calculating unit 13, a profile creating unit 14, a storing unit 37, and a control unit (control circuit) 70 constitute the drive control unit 71 shown in FIG. 7. The motor 7 and the motor drive circuit 81 constitute the driving unit 80 for rotating the intermediate transfer belt 10 as an endless moving member.

On the outer circumferential surface of the intermediate transfer belt 10, the large number of marks 5 are provided to continue at the predetermined initial pitch P0 over the moving direction indicated by the arrow F in FIGS. 7 and 8 to form the scale 250. The two optical pickups 6*a* and 6*b* are fixedly provided in a fixing section of the image forming apparatus at the interval D an integer times as large as the initial pitch P0 of the marks 5 as shown in FIG. 8 with respect to the scale 250 on the intermediate transfer belt 10 such that the interval does not fluctuate.

When the driving roller 9 is rotated by the motor 7 and the intermediate transfer belt 10 rotates in the direction indicated by the arrow F, the two optical pickups 6*a* and 6*b* outputs the respective detection signals indicated by the signals 801 and 802 in FIG. 10 as Sa and Sb according to the detection of the marks 5 of the scale 250. The optical pickups 6*a* and 6*b* sets the detection signal Sa as a gate input of the phase counter 11A, sets the detection signal Sb as a gate input of the phase counter 11B, and inputs the detection signal Sb to the mark counter 12 as count pulses. The optical pickups 6*a* and 6*b* may input the detection signal Sa to the mark counter 12 as a count pulse.

The optical pickups 6*a* and 6*b* input, as a source input of the two phase counters 11A and 11B, a clock pulse CK (generated at an extremely short fixed cycle) as a reference of operations of a not-shown microcomputer that manages and controls the entire drive control unit 71.

The phase counter 11A resets a count value to 0 at a rising edge of the detection signal Sa, starts the count of the clock pulse CK again, and outputs a count value of the count to the phase-difference calculating unit 13. The phase counter 11B also resets a count value to 0 at a rising edge of the detection signal Sb, starts the count of the clock pulse CK again, and outputs a count value of the count to the phase-difference calculating unit 13.

The phase-difference calculating unit 13 watches a count value of one of the phase counters 11A and 11B reset earlier. Thereafter, the phase-difference calculating unit 13 stores a count value at the time when the other phase counter is reset. The count value is equivalent to the delay time δt in Expression (3).

Thereafter, the phase-difference calculating unit 13 stores a count value immediately before the count value of the phase counter reset earlier is reset again. The count value at this point is equivalent to a cycle T of the detection signal Sa or Sb. Therefore, the phase-difference calculating unit 13 can easily calculate the phase difference Cab between the detection signals Sa and Sb explained with reference to FIG. 10 according to Expression 3: Cab=δt/T. In calculating the phase difference Cab as advance or delay of the detection signal Sa of the optical pickup 6*a* with respect to the detection signal Sb of the optical pickup 6*b*, when the pitch of the marks 5 is extended, the phase difference counter 11A is reset earlier and the phase difference Cab is calculated as an advance phase difference. When the pitch of the marks 5 is reduced, the phase counter 11B is reset earlier and the phase difference Cab is calculated as a delayed phase difference.

At predetermined timing before image formation is actually performed (at the time of shipment from a factory, at the time of installation, immediately after turning on a power supply, at the time of a preparation operation for an image forming operation, etc.), the intermediate transfer belt 10 is rotated. Every time the optical pickups 6*a* and 6*b* detect the mark 5, the phase difference Cab is calculated by the phase-difference calculating unit 13. When advance or delay of the phase difference Cab is discriminated, information on the advance or delay of the phase difference Cab is sent to the profile creating unit 14.

At the same time, the mark counter 12 counts the rising edge of the detection signal Sb from the optical pickup 6*b* and sends a count value of the count to the profile creating unit 14. When the optical pickup 6*b* detects a seam described later of the scale 250 or when a not-shown home position sensor detects a home position mark provided on the intermediate transfer belt 10, the mark counter 12 is reset by a signal of the detection. Thereafter, a count value N of the marks 5 equivalent to one turn of the transfer belt 10 is sequentially counted up and outputted at the rising edge of the detection signal Sb.

The phase-difference calculating unit 13 may calculate a phase difference between the falling edges of the detection signal Sa and Sb such that the phase counters 11A and 11B are reset at the falling edges of the detection signals Sa and Sb of the optical pickups 6*a* and 6*b*.

The phase counters 11A and 11B may be included in the phase-difference calculating unit 13. A phase difference of the detection signals Sa and Sb may be directly calculated (detected) using a phase comparator.

When the intermediate transfer belt 10 as an endless moving member is rotated to make one full turn, the profile creating unit 14 creates a profile of a pitch error of the mark 5 for one turn of the intermediate transfer belt 10 according to the phase differences sequentially calculated by the phase-difference calculating unit 13. This profile is data indicating characteristics peculiar to a mark-pitch error of a scale for one turn of the intermediate transfer belt 10 at this point.

For example, as described above, the cumulative moving distance Lreal from the home position according to the rotation of the intermediate transfer belt 10 is calculated by multiplying the count value N of the detection signal Sa or Sb of the optical pickup 6*a* or 6*b* (count value of the marks 5) by the scale pitch (intervals of the marks 5) P. However, actually, since the scale pitch P changes, when an extension amount (amount of change) of the scale pitch P is ΔL, the cumulative moving distance Lreal is calculated by Expression (6) as follows:

$$Lreal=N*P+\Sigma[\Delta L(k)]$$

In other words, a value obtained by adding an integral value of the amount of change ΔL of the scale pitch P to N*P can be calculated as an actual cumulative moving distance. The amount of change ΔL of the scale pitch is proportional to the phase difference Cab as described above.

Figure 12A:
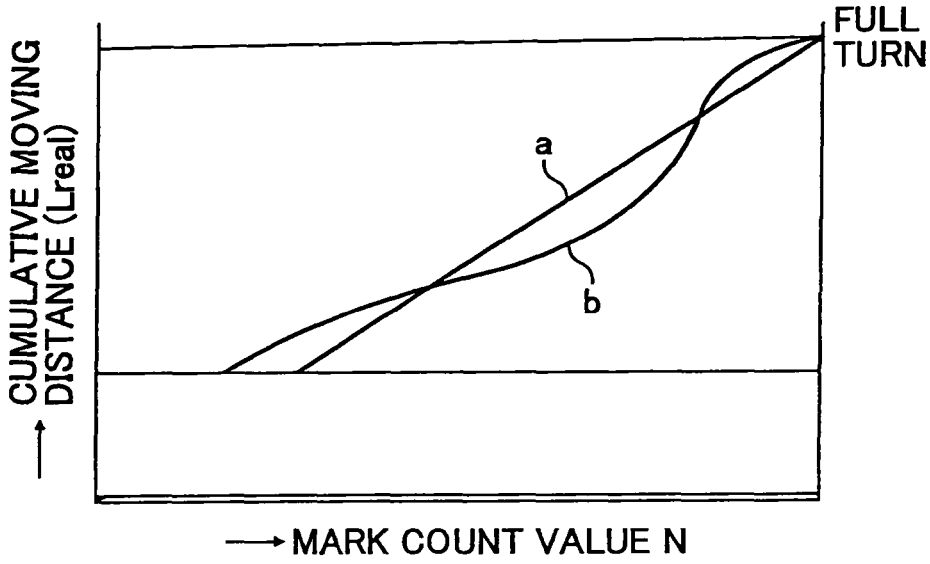
FIG. 12A is a graph of a cumulative moving distance with respect to a mark count value.

FIG. 12A is a graph of the cumulative moving distance Lreal with respect to the mark counter value N. The cumulative moving distance Lreal with respect to the count value N in an ideal case of the fixed scale pitch P and the amount of change ΔL=0 increases in proportion to the count value N of the mark counter 12 as indicated by a straight line "a" in FIG. 12A. When the cumulative moving distance Lreal reaches the distance equivalent to one turn of the intermediate transfer belt 10, the count value N is reset. However, since there is slight variation in the scale pitch p, the amount of change ΔL is not 0 but is a value proportional to the phase difference Cab calculated by the phase-difference calculating unit 13 (FIG. 6). When amounts of change ΔL are sequentially integrated and added to a value of N*P, the actual cumulative moving distance Lreal with respect to the count value N has a characteristic that the cumulative moving distance Lreal increases or decreases according to the phase difference Cab and advance or delay of the phase difference Cab with respect to the straight line "a" as indicated by a curve "b" in FIG. 12A.

The profile creating unit 14 calculates the actual cumulative moving distance Lreal with respect to the count value N of the mark counter 12 in this way and temporarily stores the characteristic indicated by the curve "b" in FIG. 12A in a memory (not shown) as a profile of a pitch error of the marks 5. Since the intervals of the marks 5 often shifts gradually when the scale 250 is printed, this pitch error often continuously changes gradually as indicated by the curve "b" in FIG. 12A. The cumulative moving distance Lreal does not suddenly change according to the increment of the count value N.

Figure 12B:
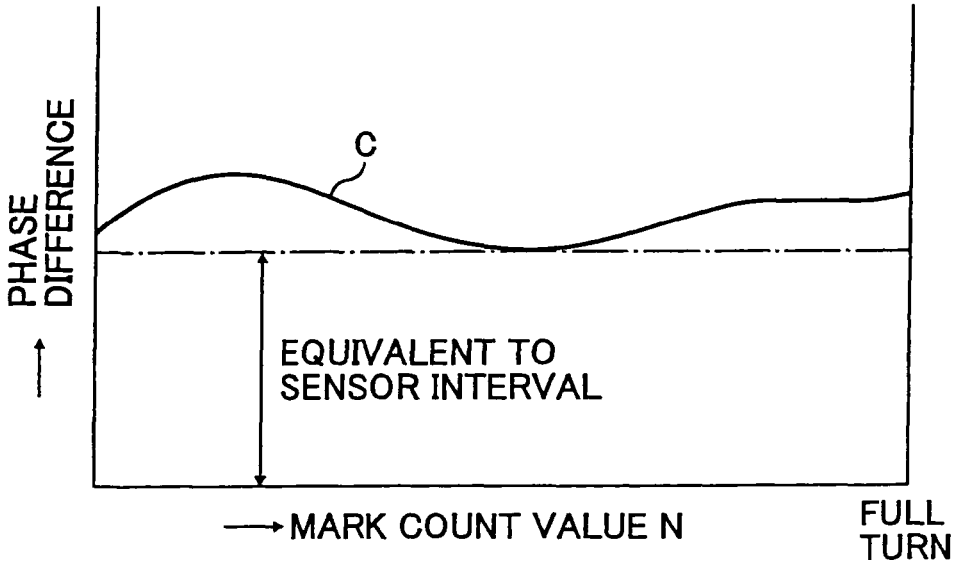
FIG. 12B is a graph of a phase difference with respect to the mark count value.

FIG. 12B is a graph of a phase difference with respect to the mark count value N. The profile creating unit 14 can also directly associate the phase differences Cab sequentially calculated by the phase-difference calculating unit 13 with the count value N, temporarily store the phase differences Cab in the memory (not shown) for one turn of the intermediate transfer belt 10 as indicated by the curve in FIG. 12B, and set the phase differences Cab as a profile of the pitch error of the marks 5. A fixed phase difference indicated by an alternate long and short dash line in FIG. 12B indicates a phase difference equivalent to the interval of the optical pickups 6*a* and 6*b*. Only the pitch error of the marks 5 may be stored as a profile without storing this phase difference.

The storing unit 37 creates mark-pitch correction data for one turn of the intermediate transfer belt 10 corresponding to the count value N from the profile of the pitch error of the marks 5 created by the profile creating unit 14 and stores the mark-pitch correction data in the memory. This is data for correcting a mark pitch to subtract the pitch error of the profile created in advance from a phase difference actually calculated or fluctuation in a cumulative moving distance proportional to the phase difference.

At the time of a normal image forming operation after that, when the intermediate transfer belt 10 rotates and the phase differences Cab are sequentially calculated by the phase-difference calculating unit 13 as describe above, a control unit 70 inputs the phase differences Cab and inputs mark-pitch correction data sequentially read out from the storing unit 37 according to count values of the mark counter 12. The control unit 70 outputs a control signal (e.g., a torque command) to the motor drive circuit 81 while correcting target position data according to the phase differences Cab and the mark-pitch correction data. The control unit 70 feedback-controls speed of movement of the intermediate transfer belt 10 by the driving unit 80.

The phase difference Cab calculated anew by the phase-difference calculating unit 13 includes, in addition to the pitch error of the marks 5, extension or contraction due to a change in temperature and humidity of the environment, a change in a tension applied to the intermediate transfer belt 10, and the like, and fluctuation due to a change in a moving speed of the intermediate transfer belt 10. The phase difference Cab is corrected by subtracting the mark-pitch error peculiar to the scale of the intermediate transfer belt 10 stored in advance from the phase difference calculated.

Therefore, even if there is an error in a mark pitch of a scale, it is possible to realize feedback control for feeding back the speed of the intermediate transfer belt 10 to the driving unit 80 to accurately compensate for expansion or contraction of the intermediate transfer belt 10 and fluctuation in a moving speed.

The respective functions of the phase-difference calculating unit 13, the profile creating unit 14, the storing unit 37, and the control unit 70 in this control device can also be realized by software processing by a not-shown microcomputer.

Even if three or more optical pickups are provided and a failure or a seam of the marks 5 are present in a position between the two optical pickups, it is possible to prevent the failure or the seam from being present in a position between the other optical pickup and the two optical pickups. Consequently, it is also possible to switch the optical pickup to be used and continuously detect an accurate phase difference in a mark discontinuous section to make it unnecessary to stop the feedback control of the moving speed of the intermediate transfer belt 10.

The position detecting device 1000 is explained above as being applied to speed control for the intermediate transfer belt 10 of the tandem color image forming apparatus shown in FIG. 5. However, the position detecting device 1000 is also applicable to speed control for other belt-like or drum-like endless moving members such as the secondary transfer belt 24 and the photosensitive members 40Y, 40C, 40M, and 40K.

That is, the position detecting device 1000 is applicable to speed control for belt-like or drum-like endless moving members related to image formation such as transfer belts, intermediate transfer belts, photosensitive belts, sheet conveying belts, intermediate transfer belts, and photosensitive drums in other image forming apparatuses such as a color or monochrome electrophotographic copier, printer, and facsimile machine.

Moreover, the position detecting device 1000 is applicable to speed control for belt-like or drum-like endless moving members that require highly accurate speed control in an inkjet color printer and other various kinds of apparatuses.

Figure 13:
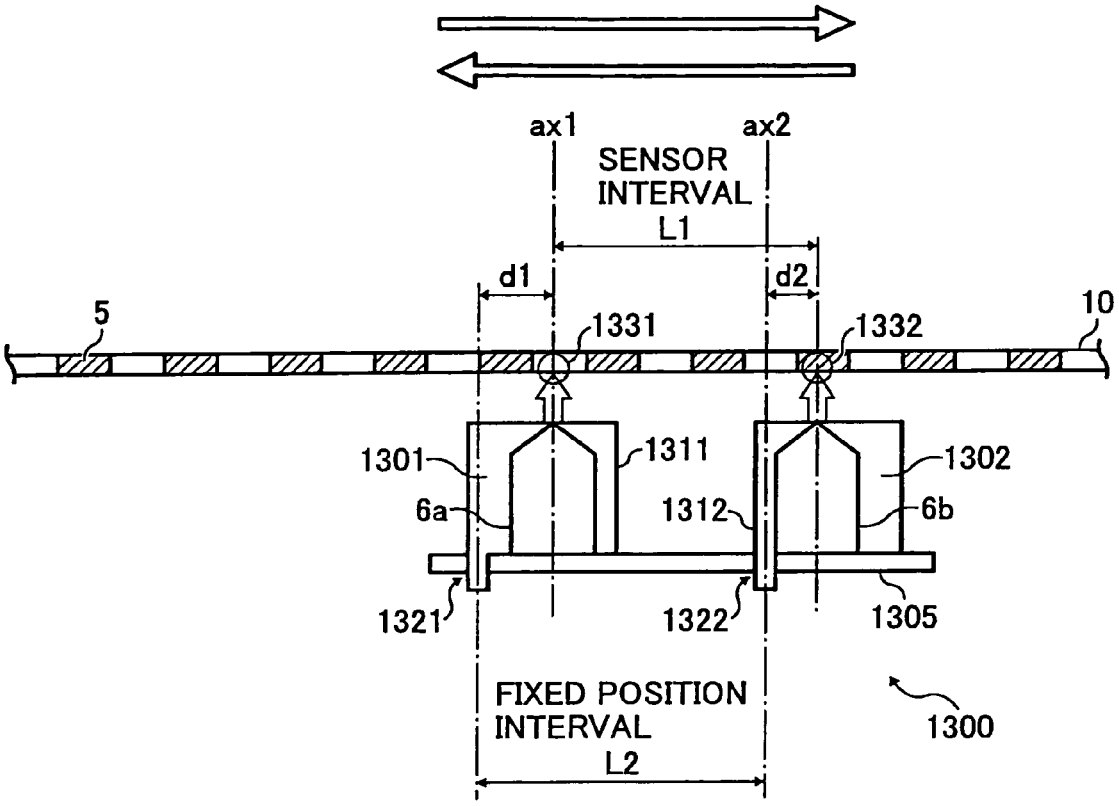
FIG. 13 is a schematic diagram for explaining a structure of a position detecting device according to a second embodiment of the present invention.

FIG. 13 is a schematic diagram for explaining a structure of a position detecting device 1300 according to a second embodiment of the present invention. In the first embodiment, the direction from the fixed positions for fixing the cases to the circuit board to the optical axes ax1 and ax2 of the two optical pickups (perpendiculars to the conveying direction of the intermediate transfer belt 10 including the detection positions) is in opposite directions in the two mark detecting units. In other words, the cases are fixed to the circuit board such that the perpendiculars in the conveying direction of the intermediate transfer belt 10 including the respective detection positions are provided on the inner sides of the perpendiculars to the conveying direction of the intermediate transfer belt 10 including the two fixed positions (see FIG. 1). On the other hand, the second embodiment is different from the first embodiment in that directions from positions where cases are fixed to a circuit board to optical axes ax1 and ax2 of two optical pickups are the same in two mark detecting units. In other words, as shown in FIG. 13, the cases are fixed to the circuit board such that the perpendiculars to the conveying direction of the intermediate transfer belt 10 including the respective detection positions are provided on the right sides of the perpendiculars to the conveying direction of the intermediate transfer belt 10 including the two fixed positions. The direction from the fixed positions to the optical axes is the conveying direction of the intermediate transfer belt 10 conveyed in an arrow direction in FIG. 13 with respect to the optical axes from the fixed positions.

The position detecting device 1300 includes a circuit board 1305, a mark detecting unit 1301, and a mark detecting unit 1302.

The mark detecting unit 1301 has a case 1311 and the optical pickup 6*a* housed in the case 1311. The mark detecting unit 1302 has a case 1312 and the optical pickup 6*b* housed in the case 1312. The optical pickups 6*a* and 6*b* are provided to be opposed to each other in the mark forming area of the marks 5 formed at the predetermined intervals on the transfer belt 10, respectively. The optical pickups 6*a* and 6*b* detect the marks 5 on the transfer belt 10, which moves when image formation is performed, in the predetermined detection positions.

In the second embodiment, the cases 1311 and 1312 are fixed to the circuit board 1305 in the same manner as previously described in the first embodiment. Projections of a substantially columnar shape are provided at the side edges of the cases 1311 and 1312. The cases 1311 and 1312 are fixed by fitting the projections into fixed positions 1321 and 1322, which are holes of a substantially circular shape provided in the circuit board 1305. The projection of the case 1311 is provided at the side edge on the opposite side of the side edge opposed to the case 1312 as in the first embodiment. However, as shown in FIG. 13, the projection of the case 1312 is provided at the side edge opposed to the case 1311.

As shown in FIG. 13, in the second embodiment, in the case 1311, a distance between a plane (fixed-position plane) perpendicular to the conveying direction of the intermediate transfer belt 10 including the fixed position 1321 in the mark detecting unit 1301 and a plane (detection-position plane) perpendicular to the conveying direction of the intermediate transfer belt 10 including the detection position 1331 is a distance d1. In the case 1312, a distance between a plane perpendicular to the conveying direction of the intermediate transfer belt 10 including the fixed position 1322 in the mark detecting unit 1302 and a plane perpendicular to the conveying direction of the intermediate transfer belt 10 including the detection position 1332 is a distance d2. A distance between the detection position 1331 and the detection position 1332 is a distance L1 and a distance between the fixed position 1321 and the fixed position 1322 is a distance L2. In this case, if a difference between an expansion amount in a direction parallel to the conveying direction of the intermediate transfer belt 10 due to a temperature change in the distance d1 of the case 1311 and an expansion amount in the direction parallel to the conveying direction of the intermediate transfer belt 10 due to a temperature change in the distance d2 of the case 1312 is substantially equal to an expansion amount due to a temperature change in the distance L2 between the fixed positions 1321 and 1322 of the circuit board 1305, the expansion amounts are offset. Thus, the distance L1 between the detection positions 1331 and 1332 is kept constant. Expansion amounts of the members are calculated in the same manner as previously described in the first embodiment.

In the second embodiment, since the cases 1311 and 1312 are formed of the same material, coefficients linear expansion of the cases 1311 and 1312 are also the same. In such a case, the mark detecting units 1301 and 1302 are formed with the distance d1 set larger than the distance d2. In the case 1312, since the projection is provided at the side edge opposed to the case 1311, the case 1312 is fixed further on the case 1311 side than the detection position 1332. Therefore, an expansion direction of the circuit board 1305 due to a temperature change and an expansion direction (right direction in FIG. 13) of the case 1312 are identical. An expansion amount of the circuit board 1305 and an expansion amount of the case 1312 offset each other. On the other hand, in the case 1311, an expansion direction of the circuit board 1305 due to a temperature change and an expansion direction of the case 1311 are opposite. An expansion amount of the circuit board 1305 and an expansion amount of the case 1311 offset each other. Therefore, the expansion amount of the case 1311 is set larger than the expansion amount of the case 1312 by setting the distance d1 larger than the distance d2. The expansion amount of the circuit board 1305 is offset by a difference between the expansion amounts in the distances d1 and d2. A total expansion amount of a plurality of cases is a total amount of expansion of the respective cases that are expanded in a direction for offsetting the expansion amount of the circuit board 1305 and returning the distance between the detection positions to the original distance. As described above, the expansion direction of the circuit board 1305 and the expansion direction of the case 1312 are identical and, even if the case 1312 is expanded in the distance d2, the case 1312 is expanded in a direction for not offsetting the expansion amount of the circuit board 1305. Thus, an expansion amount in the distance d2 is added as a negative expansion amount. The expansion direction of the circuit board 1305 and the expansion direction of the case 1311 are opposite. When the case 1301 is expanded in the distance d1, the case 1301 is expanded in a direction for offsetting the expansion amount of the circuit board 1305. Thus, an expansion amount in the distance d1 is added as a positive expansion amount. Therefore, in the second embodiment, a difference calculated by subtracting the amount of change in the distance d2 from an amount of change in the distance d1, which is an expansion amount for offsetting the expansion amount in the distance L2, is the total expansion amount. In other words, a sum of the expansion amount in the distance L2 of the circuit board 1305 and the expansion amount in the distance d2 of the case 1302 and the expansion amount in the distance d1 of the case 1301 offset each other.

In the second embodiment, since the materials of the cases 1311 and 1312 are the same, the coefficients of liner expansion of the cases 1311 and 1312 are also the same. However, the present invention is not limited to this. Coefficients of the respective cases can be different. In that case, it is not always necessary to set the distance d1 larger than the distance d2 as described above.

When the temperature of the position detecting device 1300 rises, the circuit board 1305 is expanded at a coefficient of linear expansion of the circuit board 1305. Thus, the distance L between the fixed positions 1321 and 1322 changes to be large. In this case, in the cases 1311 and 1312, the projections near the side edges are fixed to the fixed positions 1321 and 1322. Thus, the cases 1311 and 1312 move in a direction away from each other by an amount of change substantially equal to the amount of change in the distance L2 according to the expansion of the circuit board 1305. The optical pickups 6*a* and 6*b* housed in the case 1311 and 1312 also move in a direction away from each other according to the movement of the cases 1311 and 1312. As a result, the detection positions 1331 and 1332 of the optical pickups 6*a* and 6*b* also move in a direction away from each other by an amount of change substantially equal to the amount of change in the distance L2. The distance L1 increases by an amount of change substantially equal to the amount of change in the distance L2.

On the other hand, when the temperature of the position detecting device 1300 rises, the cases 1311 and 1312 are also expanded at the coefficient of linear expansion of the cases. As shown in FIG. 13, the cases 1311 and 1312 are fixed to the fixed positions 1321 and 1322 by the projections near the side edges on the same side of the cases. Thus, the cases 1311 and 1312 are expanded in an identical direction (right direction in FIG. 13). Therefore, the optical pickups 6*a* and 6*b* housed in the cases 1321 and 1322 also move in the identical direction according to the expansion of the cases 1311 and 1312. The detection positions 13331 and 1332 also move in the identical direction. In this case, the movement of the detection position 1331 is in a direction opposite to a moving direction of the mark detecting unit 1301 with respect to the mark detecting unit 1302 due to the expansion of the circuit board 1305. Thus, the detection position 1331 moves in a direction for offsetting an amount of change in the distance L1 due to the expansion of the circuit board 1305. The movement of the detection position 1332 is in a direction same as the moving direction due to the expansion of the circuit board 1305. Thus, the detection position 1332 moves in a direction opposite to the direction for offsetting the expansion amount of the circuit board 1305. As a result, both the distances d1 and d2 increase. However, since the distance d1 is larger than the distance d2, the distance L1 decreases by a difference between amounts of change in the distances d1 and d2.

If a difference between the amounts of expansion due to a temperature change of the distances d1 and d2 and the amount of expansion due to a temperature change in the distance L2 between the fixed positions of the circuit board 1305 are identical, the changed expansion amounts in the distances are offset. Thus, it is possible to control fluctuation due to a temperature change of the distance L1 between the detection positions 1311 and 1332 of the optical pickups 6*a* and 6*b*. In other words, if a sum of the expansion amount in the distance L2 of the circuit board 1305 and the expansion amount in the distance d2 of the case 1302 and the expansion amount in the distance d1 of the case 1301 are identical, the changed expansion amounts of the cases 1301 and 1302 are offset. Thus, it is possible to control fluctuation due to a temperature change in the distance L1 between the detection positions 1331 and 1332 of the optical pickups 6*a* and 6*b*.

Figure 14:
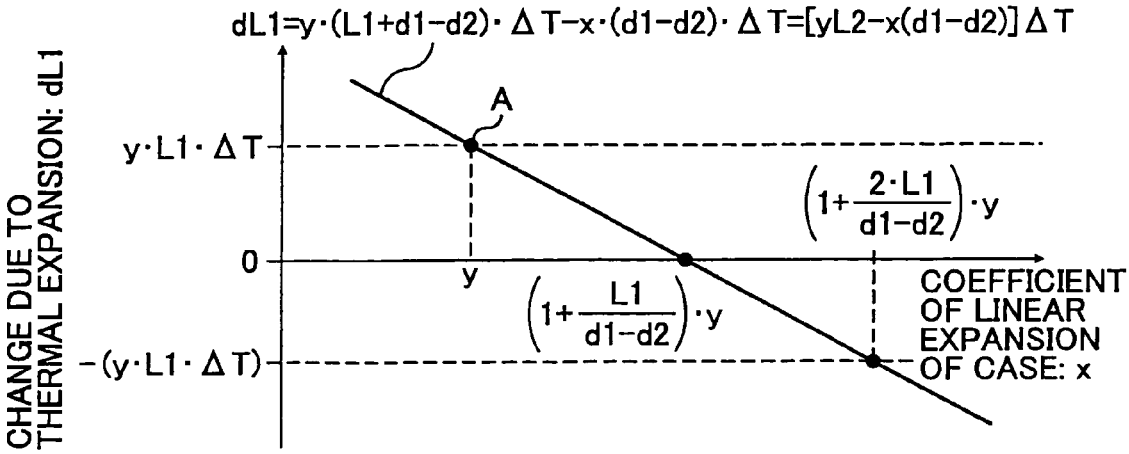
FIG. 14 is a graph for explaining an expansion change between detection positions of optical pickups in the position detecting device shown in FIG. 13.

FIG. 14 is a graph for explaining an expansion change between the detection positions of the optical pickups in the position detecting device 1300. A coefficient of linear expansion of the case 1311 and 1312 is "x" and a coefficient of linear expansion of the circuit board 1305 is "y". The circuit board 1305 also functions as a holding member that fixes and holds the cases 1311 and 1312. Since the cases 1311 and 1312 are formed of the same material, coefficients of linear expansion of the cases 1311 and 1312 are also the same.

As described above, a distance between the optical axis ax1 (perpendicular to the conveying direction of the intermediate transfer belt 10 including the detection position 1331) of the optical pickup 6*a* of the mark detecting unit 1301 and the fixed position 1321 of the case 1311 of the optical pickup 6*a* is d1. A distance between the optical axis ax2 (perpendicular to the conveying direction of the intermediate transfer belt 10 including the detection position 1332) of the optical pickup 6*b* and the fixed position 1322 of the case 1312 of the optical pickup 6*b* is d2. A distance between the detection positions 1331 and 1332 of the optical pickups 6*a* and 6*b* is L1. A distance between the fixed positions 1321 and 1322 of the circuit board 1305 is L2.

For example, when a temperature change of the position detection device 1300 is ΔT, the distance L2 between the fixed positions 1321 and 1322 is L2+yL2ΔT because of a linear expansion change due to a temperature change. A linear expansion amount due to a temperature change is yL2ΔT.

Changes in the distance d1 and the distance d2 are xd1ΔT and xd2ΔT, respectively.

With the fixed position 1321 at the left end in FIG. 13 set as a reference, a distance between the reference and the optical axis ax2 of the optical pickup 6*b* is $$L2+yL2\Delta T+d2+xd2\Delta T.$$

A distance between the reference and the optical axis ax1 of the optical pickup 6*a* is d1+d1ΔT.

Therefore, a distance between the detection positions 1331 and 1332 of the optical pickups 6*a* and 6*b* after the temperature change is represented as follows:

$$(L2+yL2\Delta T+d2+xd2\Delta T)-(d1+xd1\Delta T) \quad (8)$$

Therefore, an expansion amount due to a temperature change in the distance L1 between the detection positions 1331 and 1332 of the optical pickups 6*a* and 6*b* is $$(L2+yL2\Delta T+d2+xd2\Delta T)-(d1+xd1\Delta T)-L1.$$

By the substitution L1=L2+d2−d1, the above expression is rearranged to (yL2+xd2−xd1)ΔT, that is, rearranged as follows:

$$dL1=[yL2-x(d1-d2)]\Delta T \quad (9)$$

In FIG. 14, the abscissa indicates the coefficient of linear expansion "x" of the cases and the ordinate indicates dL1, which is an amount of change in the distance L1 between the detection positions 1331 and 1332. A point "A" in FIG. 14 is a point where d1=d2=0, i.e., L1=L2. In other words, as in the general conventional example, the point "A" indicates the displacement of the cases that occurs when the cases are fixed to the circuit board on the optical axes of the optical pickups and a change in the detection positions of the optical pickups cannot be offset. In the case of the conventional example, an expansion amount due to a temperature change of the circuit board 1305 is an amount of change in the distance L1 between the detection positions 1331 and 1332, and expressed as follows:

$$dL1=yL2\Delta T \quad (10)$$

In the mark detecting unit 1301 and the mark detecting unit 1302, it is desirable to set the parameters to satisfy the following relation:

$$-(1/10)yL1 \leqq yL2-x(d1+d2) \leqq (1/10)yL1 \quad (11)$$

where "x", "y", d1, d2, and L2 are as described above.

When parameters are selected as indicated by Expression (11), compared with the conventional example, fluctuation in the distance between the detection positions 1331 and 1332 of the optical pickups 6*a* and 6*b* due to a temperature change is controlled to be equal to or smaller than 1/10 of that in the conventional example. In other words, by selecting and adopting the parameters as indicated by Expression (11), compared with the fluctuation in the optical pickups according to the conventional example, it is possible to control a change in the distance between the detection positions 1331 and 1332 of the optical pickups 6*a* and 6*b* due to a temperature change to be equal to or smaller than 1/10 of the fluctuation.

Moreover, it is desirable to set the parameters to satisfy the following relation:

$$-(1/100)yL1 \leqq yL2-x(d1+d2) \leqq (1/100)yL1 \quad (12)$$

When parameters are selected as indicated by Expression (2), compared with the general conventional example, a change in the distance between the detection positions 1331 and 1332 of the optical pickups 6*a* and 6*b* due to a temperature change is controlled to be equal to or smaller than 1/100 of that in the conventional example.

Moreover, it is desirable to set the parameters such that a value of yL2−x(d1+d2) becomes substantially zero. When the parameters are selected in this way, compared with the fluctuation in the optical pickups according to the conventional example, it is possible to control a change in the distance between the detection positions 1331 and 1332 of the optical pickups 6*a* and 6*b* due to a temperature change to be nearly zero.

As described above, in the second embodiment, a change in the distance between the detection positions 1331 and 1332 of the optical pickups 6*a* and 6*b* is controlled to be 1/10, 1/100, or substantially zero compared with the conventional example. However, the present invention is not limited to this. The displacement of the distance between the detection positions 1331 and 1332 of the optical pickups 6*a* and 6*b* "[yL2−x(d1+d2)]ΔT" only has to be smaller than the displacement of the distance between the detection positions of the conventional optical pickups "yL1ΔT". Therefore, in general, "−CyL1≦yL2−x(d1+d2)≦CyL1" holds. In this case, "C" is a constant equal to or larger than 0 and smaller than 1. This is because, if "C" is set between 0 and 1, a displacement amount is surely smaller than the displacement of the distance between the detection positions of the conventional optical pickups "yL1ΔT".

The optical pickups 6*a* and 6*b* are fixed by fitting the projections of the cases 1311 and 1312 into the fixed positions 1321 and 1322 of the circuit board 1005. However, the optical pickups 6*a* and 6*b* may be fixed by screws. In short, it is sufficient that the side edges of the cases 1311 and 1312 are fixed to the circuit board 1305 in the fixed positions and the cases 1311 and 1312 can be stretchably displaced by a temperature change in other areas. This is because it is sufficient that shift of displacement due to a temperature change can be offset by a difference between coefficients of linear expansion of the circuit board 1305 and the cases 1311 and 1312.

In the second embodiment, it is assumed that a coefficient of linear expansion of the case members is a general linear type. Thus, dL1 described above is also a coefficient of linear expansion of the linear type according to the principle of superimposition. When the imaginary coefficient of linear expansion of the linear type with which the relative distance between the detection positions 1331 and 1332 of the optical pickups 6*a* and 6*b* changes is "z", Expression (9) for dL1 is written as dL1=zL1ΔT. Therefore, zL1ΔT is calculated as zL1ΔT=[yL2−x(d1−d2)]ΔT. This Expression can be divided by ΔT and simplified as follows:

$$zL1=yL2-x(d1-d2) \quad (13)$$

This is a relational expression of the parameters.

If the imaginary coefficient of linear expansion "z" according to superimposition is set to be zero, it is possible to reduce the fluctuation due to a temperature change between the detection positions 1331 and 1332 of the optical pickups 6*a* and 6*b*. In Expression (13), by changing (d1−d2) to (d1+d2), it is possible to apply Expression (13) to the first embodiment.

Figure 15:
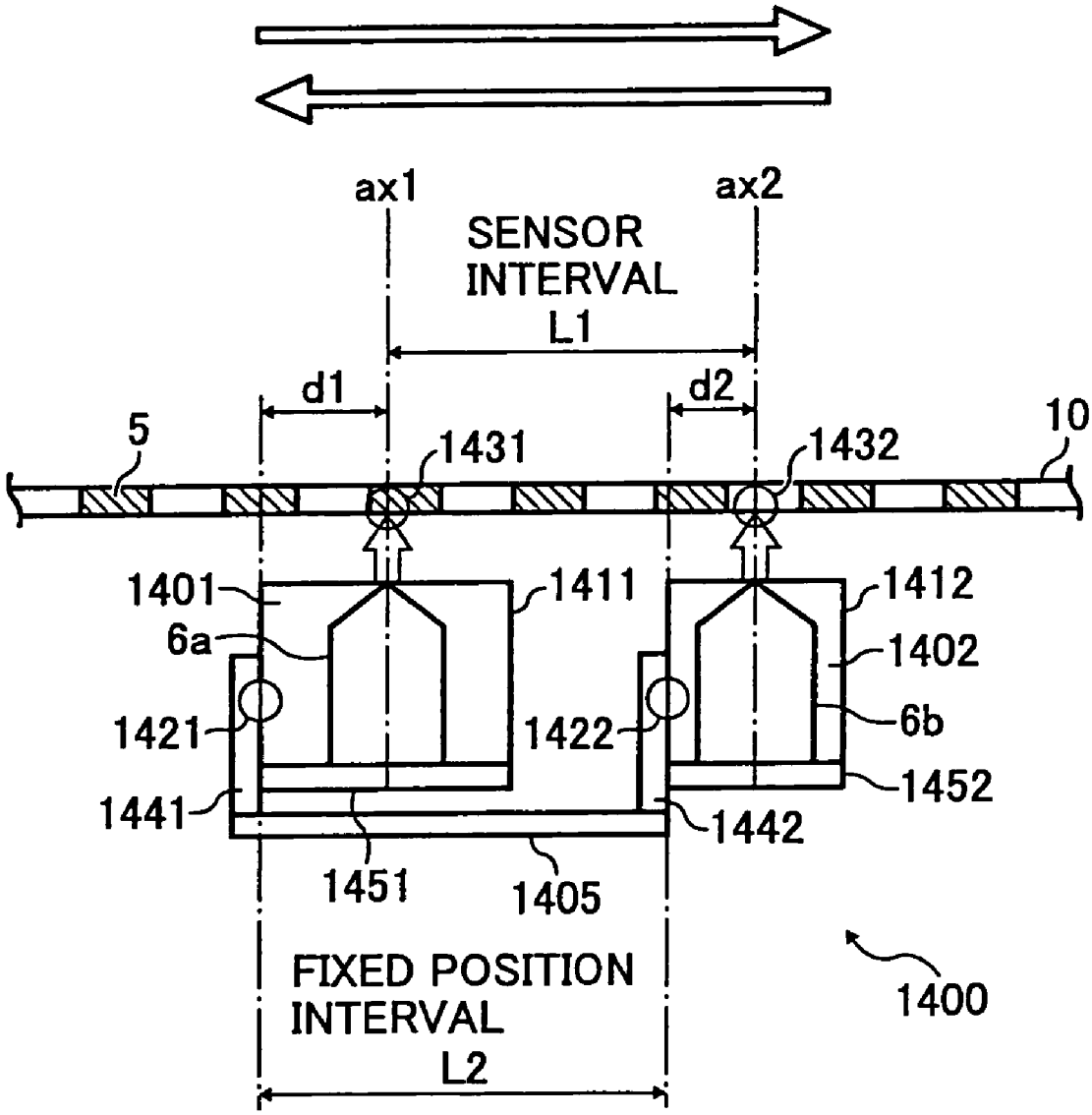
FIG. 15 is a schematic diagram for explaining a position detecting device according to a modification of the second embodiment.

FIG. 15 is a schematic diagram for explaining a position detecting device 1400 according to a modification of the second embodiment. As shown in FIG. 15, supporting members 1441 and 1442 are fixed to near side edges of a holding member 1405 in a substantially perpendicular direction from the holding member 1405. Cases 1411 and 1412 of the mark detecting units 1401 and 1402 house optical pickups 6*a* and 6*b* disposed in bottom members 1451 and 1452. The supporting members 1441 and 1442 are fixed to sides of the cases 1411 and 1412, respectively. The cases 1411 and 1412 are fixed to the supporting members 1441 and 1442 in fixed positions 1421 and 1422 to be fixed to and supported by the holding member 1405 via the supporting members 1441 and 1442. Although the cases 1411 and 1412 are fixed to the supporting member 1441 and 1442, the cases 1411 and 1412 are displaceable according to expansion and contraction of the holding member 1405 due to a temperature change.

In the modification of the second embodiment, the optical pickups 6*a* and 6*b* are fixed to the holding member 1405 via the supporting members 1441 and 1442. Otherwise, the position detecting device 1400 is of basically the same structure and operates in the same manner as the position detecting device 1300, and the same description is not repeated. As in the second embodiment, when the temperature of the position detecting device 1400 changes, even if directions from the fixed positions 1421 and 1422 to detection positions 1431 and 1432 of the optical pickups 6*a* and 6*b* are the same, expansion amounts due to a temperature change of the holding member 1405 and the cases 1411 and 1412 are offset. Thus, it is possible to control fluctuation due to a temperature change in the distance L1 between the detection positions 1431 and 1432.

In the modification of the second embodiment, a circuit board is not used as a holding member and the supporting members 1441 and 1442 are provided in the holding member 1405 separate from the circuit board. Consequently, it is possible to surely secure a degree of freedom of parameters, increase a degree of freedom of design, and reduce a change in the distance between the detection positions 1431 and 1432 of the optical pickups 6*a* and 6*b* due to a temperature change.

It is desirable to use a metal material as the holding member. The metal material has high rigidity and a small coefficient of thermal expansion due to a temperature change. Therefore, a degree of freedom for reducing the displacement of a distance due to temperature change increases. When the position detecting device is applied to an image forming apparatus, it is possible to provide a high-quality image.

In the example explained in the first embodiment, there are the two optical pickups. However, the number of optical pickups is not limited to two. In a third embodiment of the present invention, three optical pickups are provided in a conveying direction of a transfer belt.

Figure 16:
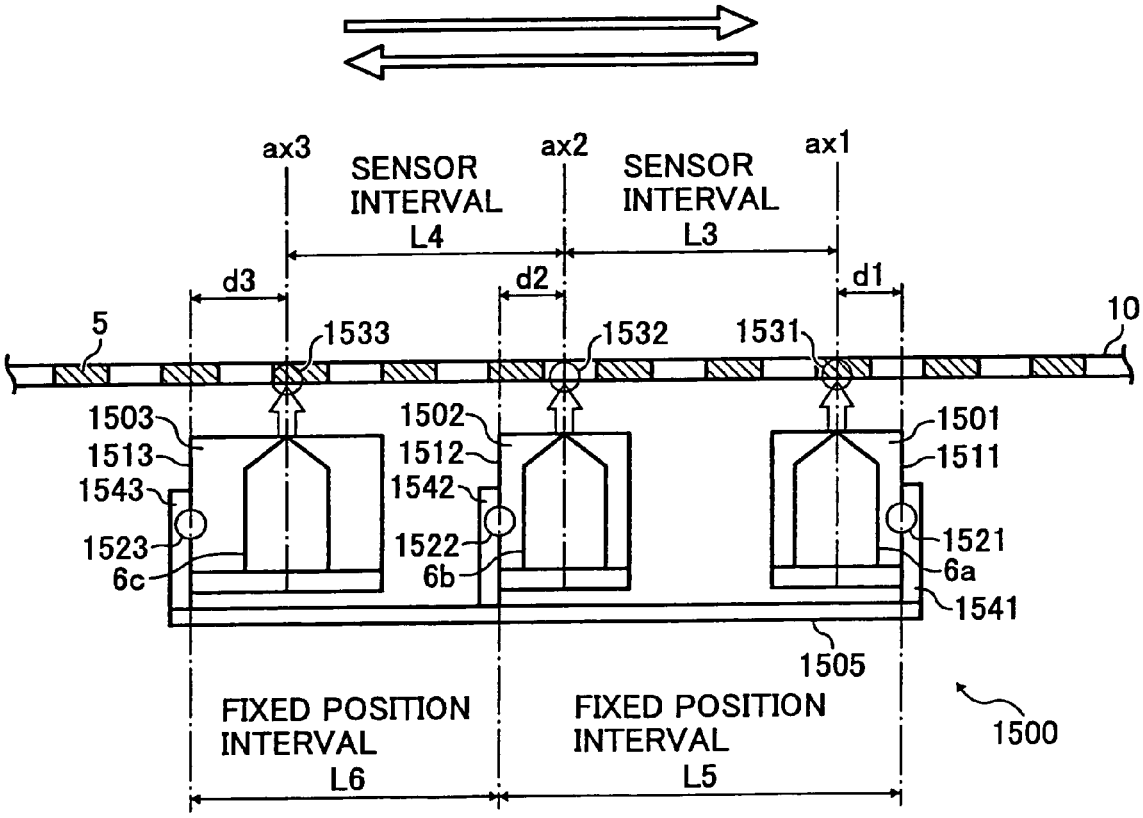
FIG. 16 is a schematic diagram for explaining a structure of a position detecting device according to a third embodiment of the present invention.

FIG. 16 is a schematic diagram for explaining a structure of a position detecting device 1500 according to the third embodiment. The position detecting device 1500 includes a mark detecting unit 1501, a mark detecting unit 1502, and a mark detecting unit 1503. The mark detecting units have cases 1511, 1512, and 1513, respectively. The cases 1511, 1512, and 1513 house the optical pickups 6*a*, 6*b*, and 6*c* disposed on bottom members. In the position detecting device 1500, supporting members 1541, 1542, and 1543 are fixed in a substantially perpendicular direction from a holding member 1505 that holds the mark detecting units. The supporting members 1541, 1542, and 1543 are fixed to sides of the cases 1511, 1512, and 1513. The cases 1511, 1512, and 1513 are fixed to the supporting members 1541, 1542, and 1543 in fixed positions 1521, 1522, and 1523 to be fixed to and supported by the holding member 1505 via the supporting members 1541, 1542, and 1543. Although the cases 1511, 1512, and 1513 are fixed to the supporting members 1541, 1542, and 1543, the cases 1511, 1512, and 1513 are displaceable according to expansion and contraction of the holding member 1505 due to a temperature change.

In the third embodiment, the optical pickups 6*a*, 6*b*, and 6*c* are fixed to the holding member 1505 via the supporting members 1541, 1542, and 1543. Otherwise, the position detecting device 1500 is of basically the same structure and operates in the same manner as the position detecting device described in the first and second embodiments, and the same description is not repeated. A relative positional relation between the mark detecting unit 1501 and the mark detecting unit 1502 is the same as that in the first embodiment. A relative positional relation between the mark detecting unit 1502 and the mark detecting unit 1503 is the same as that in the second embodiment.

As shown in FIG. 16, in the third embodiment, in the case 1511, a distance between a plane (fixed-position plane) perpendicular to the conveying direction of the intermediate transfer belt 10 including the fixed position 1521 in the mark detecting unit 1501 and a plane (detection-position plane) perpendicular to the conveying direction of the intermediate transfer belt 10 including the detection position 1531 is a distance d1. In other words, a distance between the fixed position 1521 and an optical axis ax1 is d1. In the case 1512, a distance between a plane perpendicular to the conveying direction of the intermediate transfer belt 10 including the fixed position 1522 in the mark detecting unit 1502 and a plane perpendicular to the conveying direction of the intermediate transfer belt 10 including the detection position 1532 is a distance d2. In other words, a distance between the fixed position 1522 and an optical axis ax2 is d2. In the case 1513, a distance between a plane perpendicular to the conveying direction of the intermediate transfer belt 10 including the fixed position 1523 in the mark detecting unit 1503 and a plane perpendicular to the conveying direction of the intermediate transfer belt 10 including the detection position 1533 is a distance d3. In other words, a distance between the fixed position 1523 and an optical axis ax3 is d3. A distance between the detection position 1531 and the detection position 1532 is a distance L3 and a distance between the detection position 1532 and the detection position 1533 is a distance L4. A distance between the fixed position 1521 and the fixed position 1522 is L5 and a distance between the fixed position 1522 and the fixed position 1523 is L6.

In the third embodiment, as in the first embodiment, when the temperature of the position detecting device 1500 changes by ΔT, "$-CyL3 \leqq yL5 - x(d1+d2) \leqq CyL3$" holds. In this case, "C" is a constant equal to or larger than 0 and smaller than 1. By satisfying this relational expression, expansion amounts due to a temperature change of the holding member 1505 and the cases 1511 and 1512 are offset. Thus, it is possible to control fluctuation due to a temperature change in the distance L3 between the detection positions 1531 and 1532 of the optical pickups 6*a* and 6*b*.

As in the second embodiment, when the temperature of the position detecting device 1500 changes by ΔT, "$-CyL4 \leqq yL6 - x(d3-d2) \leqq CyL4$" holds. In this case, "C" is a constant equal to or larger than 0 and smaller than 1. By satisfying this relational expression, expansion amounts due to a temperature change of the holding member 1505 and the cases 1512 and 1513 are offset. Thus, it is possible to control fluctuation due to a temperature change in the distance L4 between the detection positions 1532 and 1533 of the optical pickups 6*b* and 6*c*.

As described above, when the three mark detecting units are provided, even when an abnormal portion of a mark is present in an area for mark reading by the mark detecting units 1501 and 1502 compared with the mark 5 as a reference formed on the transfer belt 10, it is possible to accurately read the mark with the other two optical pickups, i.e., the optical pickups 6*a* and 6*c* or the optical pickups 6*b* and 6*c*.

In this case, it is also possible to offset and reduce, with a system same as that described above, distance fluctuation in the distance L3 between the detection positions 1531 and 1532 of the optical pickups 6*a* and 6*b* and the distance L4 between the detection positions 1532 and 1533 of the optical pickups 6*b* and 6*c*. In other words, a change in a distance between target optical pickups with respect to ΔT as a temperature change is detected as superimposition of coefficients of linear expansion of the respective members (cases). As explained in the second embodiment, the imaginary coefficient of linear expansion "z" is applied to the respective optical pickups to calculate and set the parameters to reduce the imaginary coefficient of expansion "z" to zero. By setting the parameters in this way, it is possible to reduce the fluctuation due to a temperature change in the distance between the target optical pickups.

It is also possible to apply the structure explained above to an drive control device and an image forming apparatus including the three mark detecting units 1501, 1502, and 1503.

As described above, the position detecting device 1500 can more accurately read marks formed on the transfer belt than the position detecting device including two mark detecting units.

Figure 17:
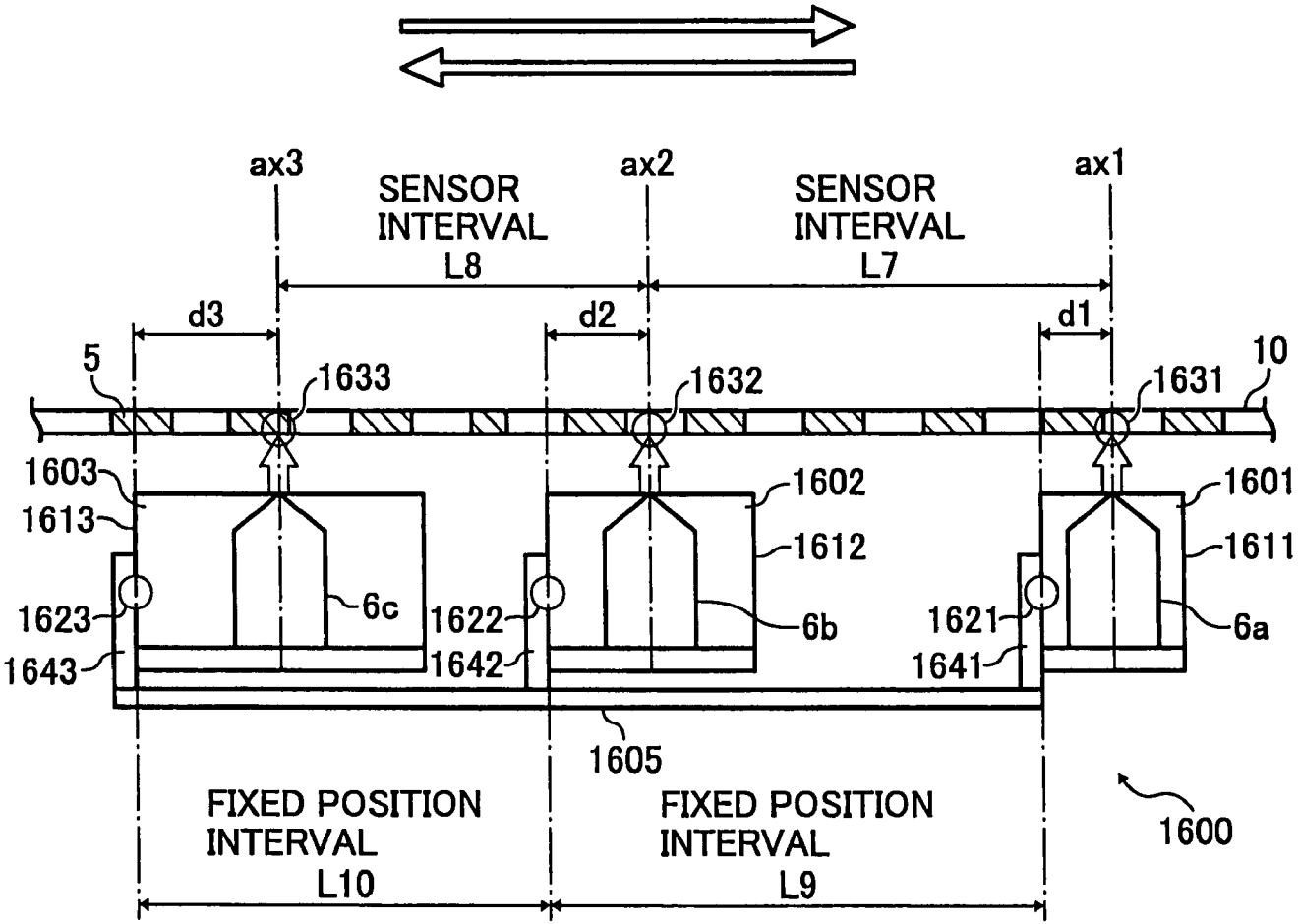
FIG. 17 is a schematic diagram for explaining a position detecting device according to a modification of the third embodiment.

FIG. 17 is a schematic diagram for explaining a position detecting device 1600 according to a modification of the third embodiment. The position detecting device 1600 includes a mark detecting unit 1601, a mark detecting unit 1602, and a mark detecting unit 1603. The mark detecting units have cases 1611, 1612, and 1613, respectively. The cases 1611, 1612, and 1613 house optical pickups 6*a*, 6*b*, and 6*c* disposed on bottom members. In the position detecting device 1600, supporting members 1641, 1642, and 1643 are fixed in a substantially perpendicular direction from a holding member 1605 that holds the mark detecting units. The supporting members 1641, 1642, and 1643 are fixed to sides of the cases 1611, 1612, and 1613. The cases 1611, 1612, and 1613 are fixed to the supporting members 1641, 1642, and 1643 in fixed positions 1621, 1622, and 1623 to be fixed to and supported by the holding member 1605 via the supporting members 1641, 1642, and 1643. Although the cases 1611, 1612, and 1613 are fixed to the supporting members 1641, 1642, and 1643, the cases 1611, 1612, and 1613 are displaceable according to expansion and contraction of the holding member 1605 due to a temperature change. In the third embodiment, the mark detecting unit 1501 is fixed to the left side of the supporting member 1541 (see FIG. 16). The modification of the third embodiment is different from the third embodiment in that the mark detecting unit 1601 is fixed to the right side in FIG. 17 of the supporting member 1641.

In the modification of the third embodiment, the optical pickups 6*a*, 6*b*, and 6*c* are fixed to the holding member 1605 via the supporting members 1641, 1642, and 1643. Otherwise, the position detecting device 1600 is of basically the same structure and operates in the same manner as the position detecting device 1500, and the same description is not repeated.

As shown in FIG. 17, in the modification of the third embodiment, in the case 1611, a distance between a plane (fixed-position plane) perpendicular to the conveying direction of the intermediate transfer belt 10 including the fixed position 1621 in the mark detecting unit 1601 and a plane (detection-position plane) perpendicular to the conveying direction of the intermediate transfer belt 10 including the detection position 1631 is a distance d1. In other words, a distance between the fixed position 1621 and an optical axis ax1 is d1. In the case 1612, a distance between a plane perpendicular to the conveying direction of the intermediate transfer belt 10 including the fixed position 1622 in the mark detecting unit 1602 and a plane perpendicular to the conveying direction of the intermediate transfer belt 10 including the detection position 1632 is a distance d2. In other words, a distance between the fixed position 1622 and an optical axis ax2 is d2. In the case 1613, a distance between a plane perpendicular to the conveying direction of the intermediate transfer belt 10 including the fixed position 1623 in the mark detecting unit 1603 and a plane perpendicular to the conveying direction of the intermediate transfer belt 10 including the detection position 1633 is a distance d3. In other words, a distance between the fixed position 1623 and an optical axis ax3 is d3. A distance between the detection position 1631 and the detection position 1632 is a distance L7 and a distance between the detection position 1632 and the detection position 1633 is a distance L8. A distance between the fixed position 1621 and the fixed position 1622 is L9 and a distance between the fixed position 1622 to the fixed position 1623 is L10.

In the modification of the third embodiment, as in the second embodiment, when the temperature of the position detecting device 1600 changes by ΔT, "$-CyL7 \leqq yL9-x(d2-d1) \leqq CyL7$" holds. In this case, "C" is a constant equal to or larger than 0 and smaller than 1. By satisfying this relational expression, expansion amounts due to a temperature change of the holding member 1605 and the cases 1611 and 1612 are offset. Thus, it is possible to control fluctuation due to a temperature change in the distance L7 between the detection positions 1631 and 1632 of the optical pickups 6*a* and 6*b*.

As in the second embodiment, when the temperature of the position detecting device 1600 changes by ΔT, "$-CyL8 \leqq yL10-x(d3-d2) \leqq CyL8$" holds. In this case, "C" is a constant equal to or larger than 0 and smaller than 1. By satisfying this relational expression, expansion amounts due to a temperature change of the holding member 1605 and the cases 1612 and 1613 are offset. Thus, it is possible to control fluctuation due to a temperature change in the distance L8 between the detection positions 1632 and 1633 of the optical pickups 6*b* and 6*c*.

With such a structure, even if the optical pickups 6*a*, 6*b*, and 6*c* are fixed to the fixed positions 1621, 1622, and 1623 of the holding member 1605 and directions from the fixed positions 1621, 1622, and 1623 to the optical axes ax1, ax2, and ax3 of the optical pickups 6*a*, 6*b*, and 6*c* are the same, it is possible to offset changes in distances among the optical pickups 6*a*, 6*b*, and 6*c* due to a temperature change as described above.

In this case, it is also possible to offset and reduce, with a system same as that described above, distance fluctuation in the distance L7 between the detection positions 1631 and 1632 of the optical pickups 6*a* and 6*b* and the distance L8 between the detection positions 1632 and 1633 of the optical pickups 6*b* and 6*c*. In other words, a change in a distance between target optical pickups with respect to ΔT as a temperature change is detected as superimposition of coefficients of linear expansion of the respective members (cases). As explained in the third embodiment, the imaginary coefficient of linear expansion "z" is applied to the respective optical pickups to calculate and set the parameters to reduce the imaginary coefficient of expansion "z" to zero. By setting the parameters in this way, it is possible to reduce a change in the distance between the target optical pickups.

With the structure in which the supporting members are provided in the holding member, it is possible to more surely secure a higher degree of freedom of parameters. It is also possible to increase a degree of freedom of design and reduce a change in a distance between optical pickups due to a temperature change.

Figure 18:
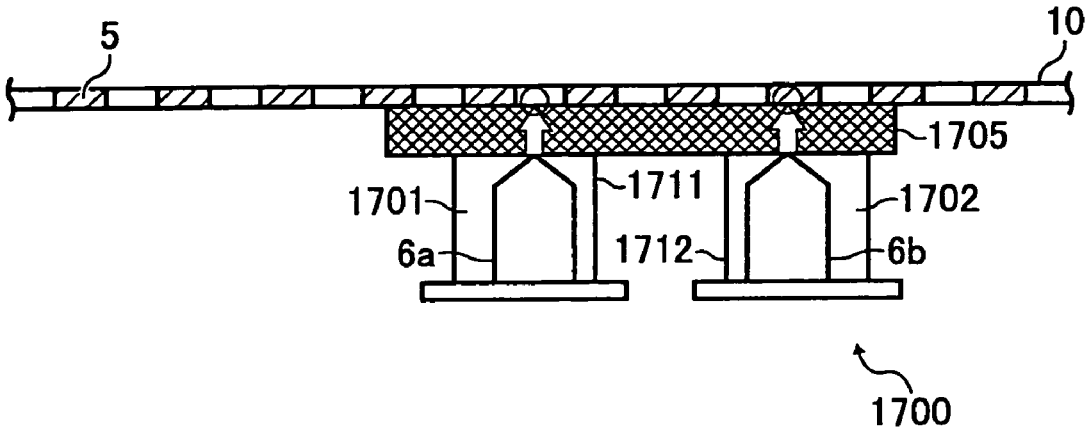
FIG. 18 is a schematic diagram for explaining a structure of a position detecting device according to another embodiment of the present invention.

In the first to third embodiments, the mark detecting units are fixed to and held by the circuit board and the holding member on the opposite side of detection sides of marks in the optical pickups. However, the present invention is not limited to this. For example, the mark detecting units can be fixed to and held by the holding member on the detection sides of marks in the optical pickups. FIG. 18 is a schematic diagram for explaining a structure of a position detecting device 1700 according to another embodiment of the present invention. The position detecting device 1700 includes a mark detecting unit 1701 and a mark detecting unit 1702. A spacer 1705 may fix and hold a detection side of the marks 5 of the optical pickup 6*a* housed in the case of the mark detecting unit 1701 and a detection side of the marks 5 of the optical pickup 6*b* housed in the case 1712 of the mark detecting unit 1702. A relation between fixed positions and detection positions is the same as previously described in the first to third embodiments. In this case, it is possible to keep a distance between the optical pickups 6*a* and 6*b* and the transfer belt 10 with the spacer 1705 constant.

In the first to third embodiments, an example is explained in which the cases and the circuit board (holding member) are expanded by a temperature change. The present invention can achieve a similar effect when the cases and the circuit board (holding member) are contracted by a temperature change. In this case, the contraction of the cases and the contraction of the circuit board (holding member) only have to be offset.

In the examples explained in the first to third embodiments, the position detecting device detects the marks formed on the transfer belt in the image forming apparatus. However, the present invention is not limited to this. For example, the position detecting device can be used to detect marks formed on a drum rather than on the transfer belt. The position detecting device can be used to detect marks formed on an object reciprocatingly moving on a straight line rather than on a rotating object like the transfer belt.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A position detecting device comprising:

a plurality of detecting units that faces a mark-formation area of an object where marks are formed at predetermined intervals, and detects the marks at detection positions while the object is moving;

a plurality of housing units each housing one of the detecting units; and a holding member that fixedly holds the housing units at fixed positions, wherein a total expansion amount of the housing units due to temperature change is substantially equal to an expansion amount of the holding member between the fixed positions due to temperature change, the total expansion amount representing a total amount of expansion of the housing units from a fixed-position plane to a detection-position plane in a direction parallel to a moving direction of the object, the fixed-position plane including one of the fixed positions and perpendicular to the moving direction of the object, and the detection-position plane including one of the detection positions and perpendicular to the moving direction of the object.

2. The position detecting device according to claim 1, wherein an expansion amount of each of the housing units is a product of a distance between the fixed-position plane and the detection-position plane, an expansion coefficient of the housing units, and a temperature-change amount in the housing units, the expansion amount of the holding member is a product of a distance between fixed positions for a pair of the housing units, an expansion coefficient of the holding member, and a temperature-change amount of the holding member, and the holding member fixedly holds the housing units at the fixed positions where the total expansion amount of the housing units is substantially equal to the expansion amount of the holding member.

3. The position detecting device according to claim 2, wherein the housing units include a first housing unit and a second housing unit, the detecting units include a first detecting unit that is housed in the first housing unit and detects the marks at a first detection position of the detection positions; and a second detecting unit that is housed in the second housing unit and detects the marks at a second detection position of the detection positions, the fixed positions include a first fixed position that is located between the first detection position and a side edge of the first housing unit opposite to a side edge facing the second housing unit; and a second fixed position that is located between the second detection position and a side edge of the second housing unit opposite to a side edge facing the first housing unit, the total expansion amount includes a sum of an expansion amount of the first housing unit from a first fixed-position plane including the first fixed position to a first detection-position plane including the first detection position and an expansion amount of the second housing unit from a second fixed-position plane including the second fixed position to a second detection-position plane including the second detection position, and the holding member fixedly holds the first housing unit at the first fixed position and the second housing unit at the second fixed position such that the expansion amount of the holding member from the first fixed position to the second fixed position is substantially equal to the sum of the expansion amount of the first housing unit and the expansion amount of the second housing unit.

4. The position detecting device according to claim 3, wherein at least one of the first housing unit and the second housing unit is formed of a material having an expansion coefficient larger than the expansion coefficient of the holding member.

5. The position detecting device according to claim 4, wherein the first housing unit and the second housing unit have a substantially identical expansion coefficient, and are formed of a material having an expansion coefficient larger than the expansion coefficient of the holding member, and the housing units and the holding member satisfy a relation: $-CyL1 \leqq yL2-x(d1+d2) \leqq CyL1$ where x is the expansion coefficient of the housing units, y is the expansion coefficient of the holding member, L1 is a distance between the first detection position and the second detection position, L2 is a distance between the first fixed position and the second fixed position, d1 is a distance between the first fixed-position plane and the first detection-position plane, d2 is a distance between the second fixed-position plane and the second detection-position plane, and C is a constant that satisfies $0 \leqq C \leqq 1$.

6. The position detecting device according to claim 3, wherein the housing units further include a third housing unit, the detecting units further include a third detecting unit that is housed in the third housing unit and detects the marks at a third detection position of the detection positions, the fixed positions further include a third fixed position that is located between the third detection position and a side edge of the third housing unit opposite to a side edge facing the second housing unit, the second fixed position is located between the second detection position and a side edge of the second housing unit facing the third housing unit, the total expansion-amount further includes an expansion-amount difference obtained by subtracting the expansion amount of the second housing unit from an expansion amount of the third housing unit from a fixed-position plane including the third fixed position to a detection-position plane including the third detection position, and the holding member fixedly holds the second housing unit at the second fixed position and the third housing unit at the third fixed position such that the expansion amount of the holding member from the third fixed position to the second fixed position is substantially equal to the expansion-amount difference.

7. The position detecting device according to claim 2, wherein the housing units include a first housing unit and a second housing unit, the detecting units include a first detecting unit that is housed in the first housing unit and detects the marks at a first detection position of the detection positions; and a second detecting unit that is housed in the second housing unit and detects the marks at a second detection position of the detection positions, the fixed positions include a first fixed position that is located between the first detection position and a side edge of the first housing unit opposite to a side edge facing the second housing unit; and a second fixed position that is located between the second detection position and a side edge of the second housing unit facing the first housing unit, the total expansion amount includes an expansion-amount difference obtained by subtracting an expansion amount of the second housing unit from a second fixed-position plane including the second fixed position to a second detection-position plane including the second detection position from an expansion amount of the first housing unit from a first fixed-position plane including the first fixed position to a first detection-position plane including the first detection position, and the holding member fixedly holds the first housing unit at the first fixed position and the second housing unit at the second fixed position such that the expansion amount of the holding member from the first fixed position to the second fixed position is substantially equal to the expansion-amount difference.

8. The position detecting device according to claim 7, wherein the first housing unit is formed of a material having an expansion coefficient larger than the expansion coefficient of the holding member.

9. The position detecting device according to claim 8, wherein the housing units and the holding member satisfy a relation:

$$-CyL1 \leqq yL2-x(d1-d2) \leqq CyL1$$

where x is the expansion coefficient of the housing units, y is the expansion coefficient of the holding member, L1 is a distance between the first detection position and the second detection position, L2 is a distance between the first fixed position and the second fixed position, d1 is a distance between the first fixed-position plane and the first detection-position plane, d2 is a distance between the second fixed-position plane and the second detection-position plane, and C is a constant that satisfies $0 \leqq C < 1$.

10. The position detecting device according to claim 7, wherein the housing units further include a third housing unit, the detecting units further include a third detecting unit that is housed in the third housing unit and detects the marks at a third detection position of the detection positions, the fixed positions further include a third fixed position that is located between the third detection position and a side edge of the third housing unit facing the second housing unit, the second fixed position is located between the second detection position and a side edge of the second housing unit opposite to a side edge facing the third housing unit, the total expansion amount further includes an expansion-amount difference obtained by subtracting an expansion amount of the third housing unit from a fixed-position plane including the third fixed position to a detection-position plane including the third detection position from the expansion amount of the second housing unit, and the holding member fixedly holds the second housing unit at the second fixed position and the third housing unit at the third fixed position such that the expansion amount of the holding member from the second fixed position to the third fixed position is substantially equal to the expansion-amount difference.

11. The position detecting device according to claim 1, wherein the detecting units are optical sensors or magnetic sensors.

12. An image forming apparatus comprising:

a driving unit that drives an endless transfer member on which marks are formed at predetermined intervals;

an image forming unit that forms an electrostatic latent image on a photosensitive member based on image data, forms a visual image from the electrostatic latent image, and transfers the visual image onto the endless transfer member;

a position detecting unit that detects positions of the marks on the endless transfer member driven by the driving unit;

a drive control unit that controls the driving unit based on the positions of the marks detected by the position detecting unit; and an output unit that transfers the visual image on the endless transfer member driven by the driving unit onto a recording medium, wherein the position detecting unit includes a plurality of detecting units that faces a mark-formation area of the endless transfer member, and detects the marks at detection positions while the endless transfer member is moving;

a plurality of housing units each housing one of the detecting units; and a holding member that fixedly holds the housing units at fixed positions, wherein a total expansion amount of the housing units due to temperature change is substantially equal to an expansion amount of the holding member between the fixed positions due to temperature change, the total expansion amount representing a total amount of expansion of the housing units from a fixed-position plane to a detection-position plane in a direction parallel to a moving direction of the endless transfer member, the fixed-position plane including one of the fixed positions and perpendicular to the moving direction of the endless transfer member, and the detection-position plane including one of the detection positions and perpendicular to the moving direction of the endless transfer member.

* * * * *